US007971395B1

(12) United States Patent
Vigil et al.

(10) Patent No.: US 7,971,395 B1
(45) Date of Patent: Jul. 5, 2011

(54) MULTIPURPOSE ADJUSTABLE PANEL SYSTEM

(75) Inventors: Todd S Vigil, Waconia, MN (US); Steven J. Zechmeister, Brooklyn Park, MN (US); Michael R. Hayden, Edina, MN (US)

(73) Assignee: Staging Concepts, Inc., Brooklyn Park, MN (US)

( * ) Notice: Subject to any disclaimer, the term of this patent is extended or adjusted under 35 U.S.C. 154(b) by 1002 days.

(21) Appl. No.: 11/331,326

(22) Filed: Jan. 12, 2006

(51) Int. Cl.
*E04H 3/12* (2006.01)

(52) U.S. Cl. ..... 52/9; 52/6

(58) Field of Classification Search ..... 52/6–9, 52/183, 126.5, 126.6
See application file for complete search history.

(56) References Cited

U.S. PATENT DOCUMENTS

| | | | | |
|---|---|---|---|---|
| 4,747,238 | A * | 5/1988 | Wikstrom et al. | 52/8 |
| 6,003,270 | A * | 12/1999 | MacIntyre | 52/10 |
| 6,574,923 | B1 * | 6/2003 | Johnsson et al. | 52/8 |
| 6,820,374 | B2 * | 11/2004 | Schworer | 52/7 |
| 7,621,236 | B2 * | 11/2009 | Steffey et al. | 119/847 |

* cited by examiner

*Primary Examiner* — Brian Glessner
*Assistant Examiner* — Daniel Kenny
(74) *Attorney, Agent, or Firm* — Hugh D. Jaeger

(57) ABSTRACT

A multipurpose adjustable panel system having support beams continuously adjustable between zero pitch and a pitch exceeding zero, wherein support beam pitch is influenced by vertical adjustment of support post assemblies and by horizontal spacing of support post assemblies. Multiple mounting fixtures are incorporated to accommodate beam pitch adjustment including pivotable beam support fixtures adjustably and positionably secured along the bottoms of the beams and pivotable panel support node fixtures adjustably and positionably secured along the tops of the beams, the pivotable beam support fixtures and the pivotable panel support node fixtures enabling ready adjustment of the pitch of the beams.

30 Claims, 33 Drawing Sheets

MULTIPURPOSE ADJUSTABLE PANEL SYSTEM

CROSS REFERENCES TO RELATED APPLICATIONS

This patent application is related to patent application Ser. No. 08/954,573 filed Oct. 20, 1997, entitled "Stage System," now U.S. Pat. No. 5,935,675.

BACKGROUND OF THE INVENTION

1. Field of the Invention

The present invention is for a multipurpose adjustable panel system for use as, but not limited to, tiered or level support of seating, and for covering of expansive objects such as a swimming pool.

2. Description of the Prior Art

Prior art panel systems, such as incorporated into use for support of tiered seating, often were limited to the use of pre-arranged geometrical configurations having limited or no component adjustability for different pitches of support beams. If adjustability was possible, only a few settings were available. Often, attachment fixtures of various sorts attached to the tops and bottoms of support beams or other supporting structures were stationary along the lengths of the support beams and other support structures, thereby limiting the placement and utilization of support posts and the placement and utilization of platform panels placed thereupon. Often, attachment fixtures were of limited adaptability and were completely lacking in angular adjustment features. The present invention overcomes the shortcomings of previous devices by providing variable geometry structures and variable support methods for the support of such beams and platform panels.

SUMMARY OF THE INVENTION

The general purpose of the present invention is to provide a multipurpose adjustable panel system. The instant invention includes horizontally aligned platform panels and closely connected fixtures, wherein successive adjacent platform panels are continuously and progressively adjustable between a maximum attainable tier height and a level non-tier minimum height. Geometrically configured symmetrically shaped beams are provided in opposition for use with multiple fixtures for the support of the platform panels, wherein the beams and fixtures can be oriented and utilized in more than one position and/or in various combinations to provide for multiple and various configurations for maximum usefulness incorporating all or some of the components of the multipurpose adjustable panel system. A plurality of pivotable panel support node fixtures slidingly affix and can be fixedly secured to and along an upper slotted region of the beams to provide for support of corners of the platform panels. Support post assemblies capable of height adjustment utilizing various arrangements are provided for support of the beams by the use of pivotable beam support fixtures which slidingly affix and which can be fixedly secured to and along a lower slotted region of the beams. Fixed connectors, adjustable connectors, screw jack connectors, and post connectors are incorporated for use with the support post assemblies to provide for various configurations, combinations and regimes of connectivity of components of the support post assemblies either within the support post assemblies or for connection of the support post assemblies to the lower slotted region of the beams in association with the pivotable beam support fixtures, as well as to components comprising screw jacks. The vertical distribution of adjacent tiers of platform panels is adjustable between a maximum attainable tier height and a level non-tier minimum height by changing the elevation of like ends at one end of the parallel beams by adjusting the height of the support post assemblies thereunder. The pivotable beam support fixtures and the pivotable panel support node fixtures can be readily and slidingly repositioned along the upper and lower regions of the beams. The pivotable beam support fixtures are automatically pivoted to conform to the angle or pitch of the beams in order to provide for desired angular support for the beams. The pivotable panel support node fixtures can be slidingly positioned to a position of desired spacing for placement of two corners of the plurality of platform panels along the upper region of the beams. Adjustable foot support posts can also be provided at one end of the platform panels for support of the outwardly located corners thereof depending upon the configuration of the components. If platform panels are in place, the pivotable panel support node fixtures are automatically pivoted when the adjustable foot support posts are adjusted.

According to one or more embodiments of the present invention, there is provided a multipurpose adjustable panel system including opposed parallel geometrically configured symmetrically shaped beams, herein interchangeably referred to as beams, a plurality of like pivotable panel support node fixtures which slidingly position along and which can fixably engage slots in the upper region of the beams, a plurality of platform panels two corners of which align to pivotable panel support node fixtures and two corners of which can have adjustable foot support posts which align to an upper surface of a successive lower panel to a floor or to another surface, a plurality of like pivotable beam support fixtures which slidingly position along and which can fixably engage slots in the lower region of the beams, adjustable connectors attached between the pivotable beam support fixtures and some adjustable posts of a support post assembly, fixed connectors attached between the pivotable beam support fixtures and some adjustable posts of a support post assembly, screw jack connectors attached to the lower ends of fixed posts of a support post assembly, screw jack components extending between screw jack connectors, a screw jack and a baseplate, interconnect tubes between support post assemblies, and transversely oriented cross bracing between opposed interconnect tubes.

One significant aspect and feature of the multipurpose adjustable panel system, the present invention, is continuous beam pitch adjustability within a range to accommodate and support platform panels.

Another significant aspect and feature of the present invention is the use of beams having an upper bifurcated support panel including a co-located slot opposed to a lower bifurcated support panel including a co-located slot.

Another significant aspect and feature of the present invention is the use of a pivotable panel support node fixture slidably engaged and securable along an upper slot of a beam.

Yet another significant aspect and feature of the present invention is the use of a pivotable panel support node fixture which adjustably and automatically accommodates and supports one end of a platform panel which is adjustably leveled in angular respect to the pitch of the beam.

Still another significant aspect and feature of the present invention is the use of a pivotable beam support fixture slidably engaged and securable along a lower slot of a beam.

A further significant aspect and feature of the present invention is the use of a pivotable beam support fixture including variable pitch components wherein the pitch is adjustably determined by the pitch of a beam.

Another significant aspect and feature of the present invention is positionable support post assemblies each having vertically slidable telescoping relationships of the components as part of a first adjustment.

Another significant aspect and feature of the present invention is the horizontal spacing of positionable support post assemblies as part of a first adjustment.

Still another significant aspect and feature of the present invention is the use of adjustable connectors between the tops of positionable support post assemblies and the pivotable beam support fixtures to provide a second adjustment.

Yet another significant aspect and feature of the present invention is a third adjustment at the bottom of each of the positionable support post assemblies provided by the use of a screw jack.

A further significant aspect and feature of the present invention is the use of support post assemblies which are positionable and which are stackable.

An additional significant aspect and feature of the present invention is a multipurpose adjustable panel system continuously and variably usable between a zero pitch and a pitch of greater degree wherein pivotable panel support node fixtures and pivotable beam support fixtures are continuously and variably usable along the length of the beams in pitched or non-pitched arrangements.

Still another significant aspect and feature of the present invention is a multipurpose adjustable panel system wherein all or some of the components are used to provide various usable configurations thereof.

Having thus briefly described one or more embodiments of the present invention and having mentioned some significant aspects and features of the present invention, it is the principal object of the present invention to provide a multipurpose adjustable panel system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
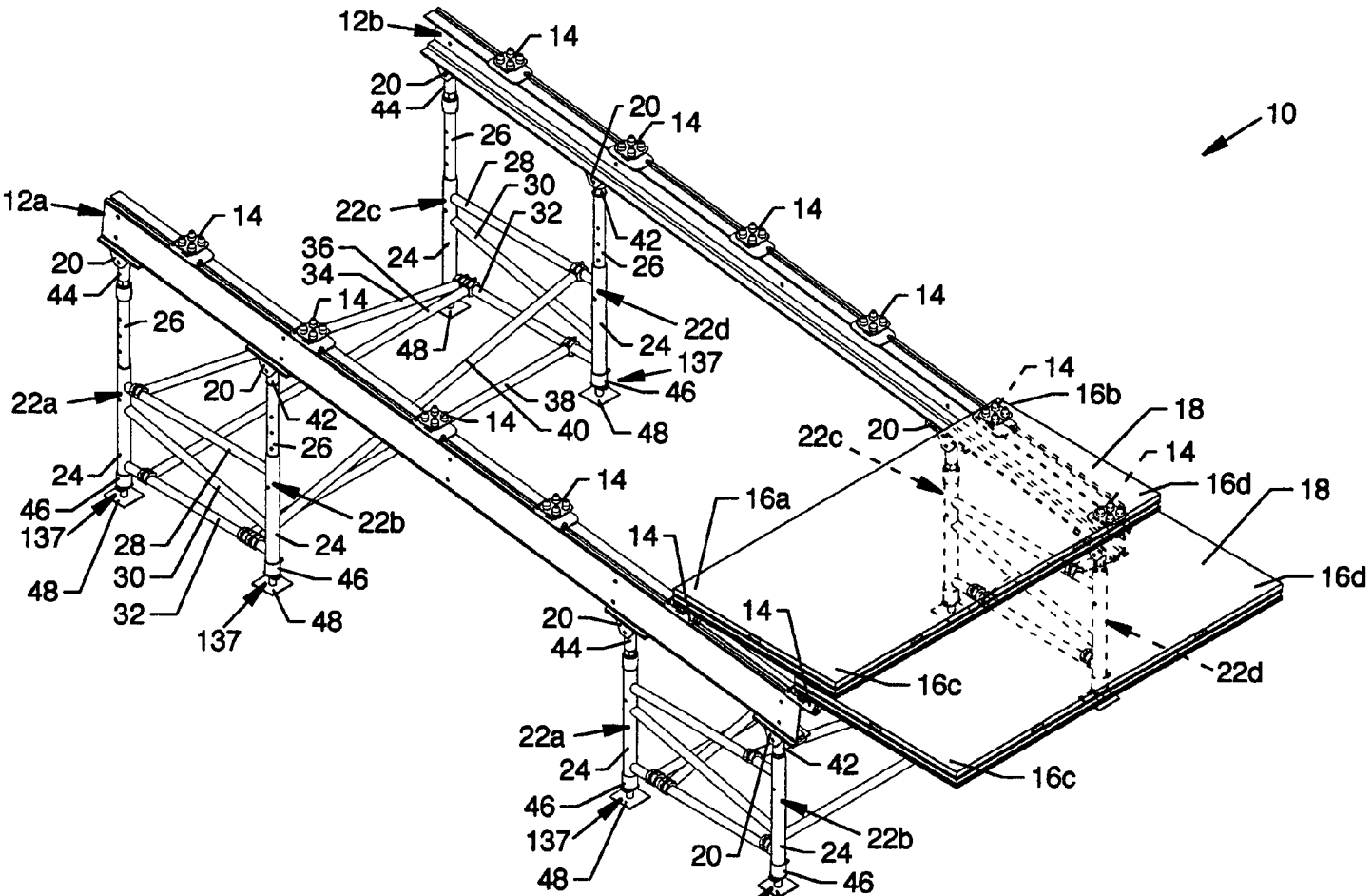
FIG. 1 is an isometric view of a multipurpose adjustable panel system, the present invention.
Figure 11:
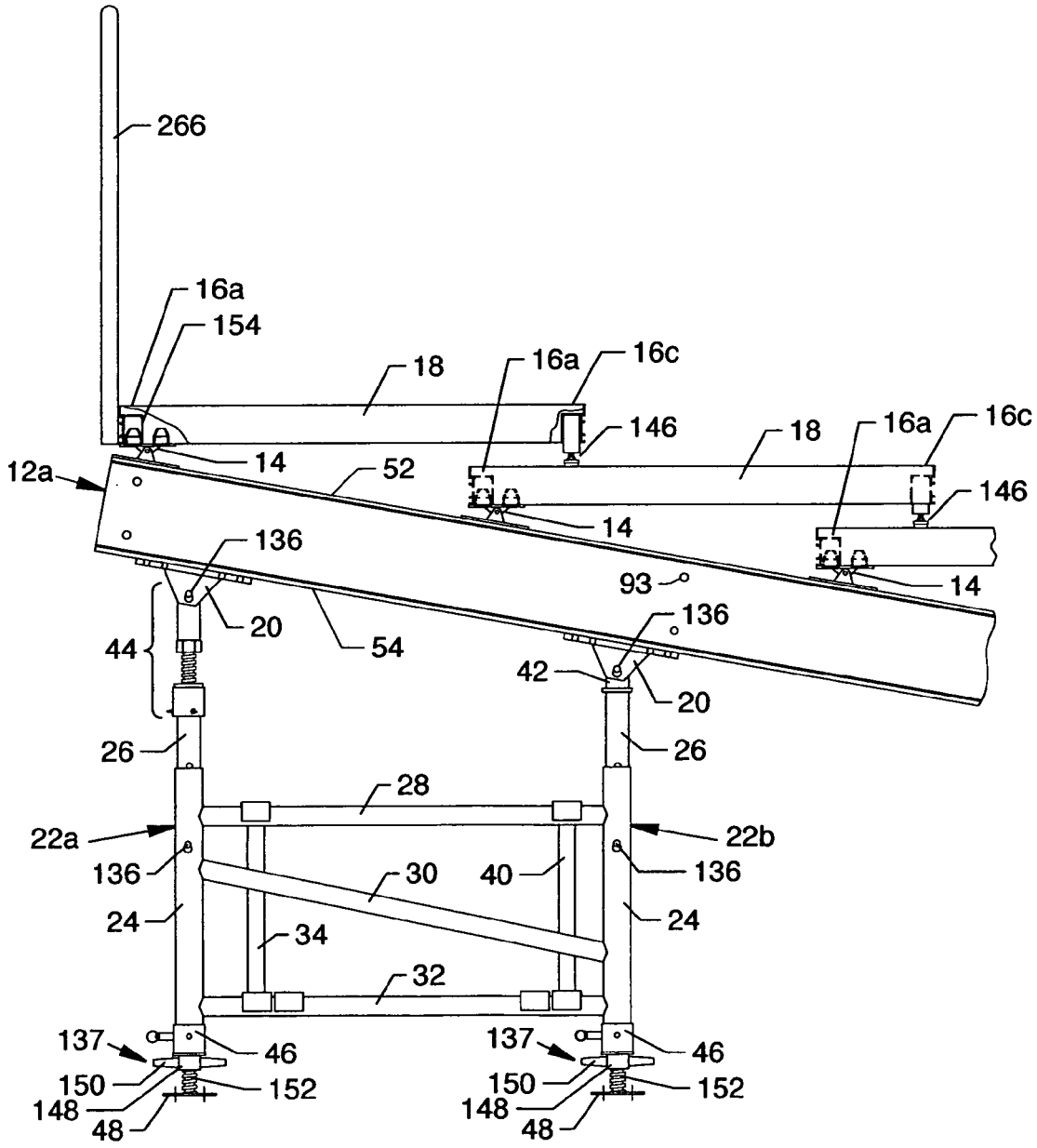
FIGS. 11 and 12 are side views of the structure supporting the beams in various configurations.
Figure 12:
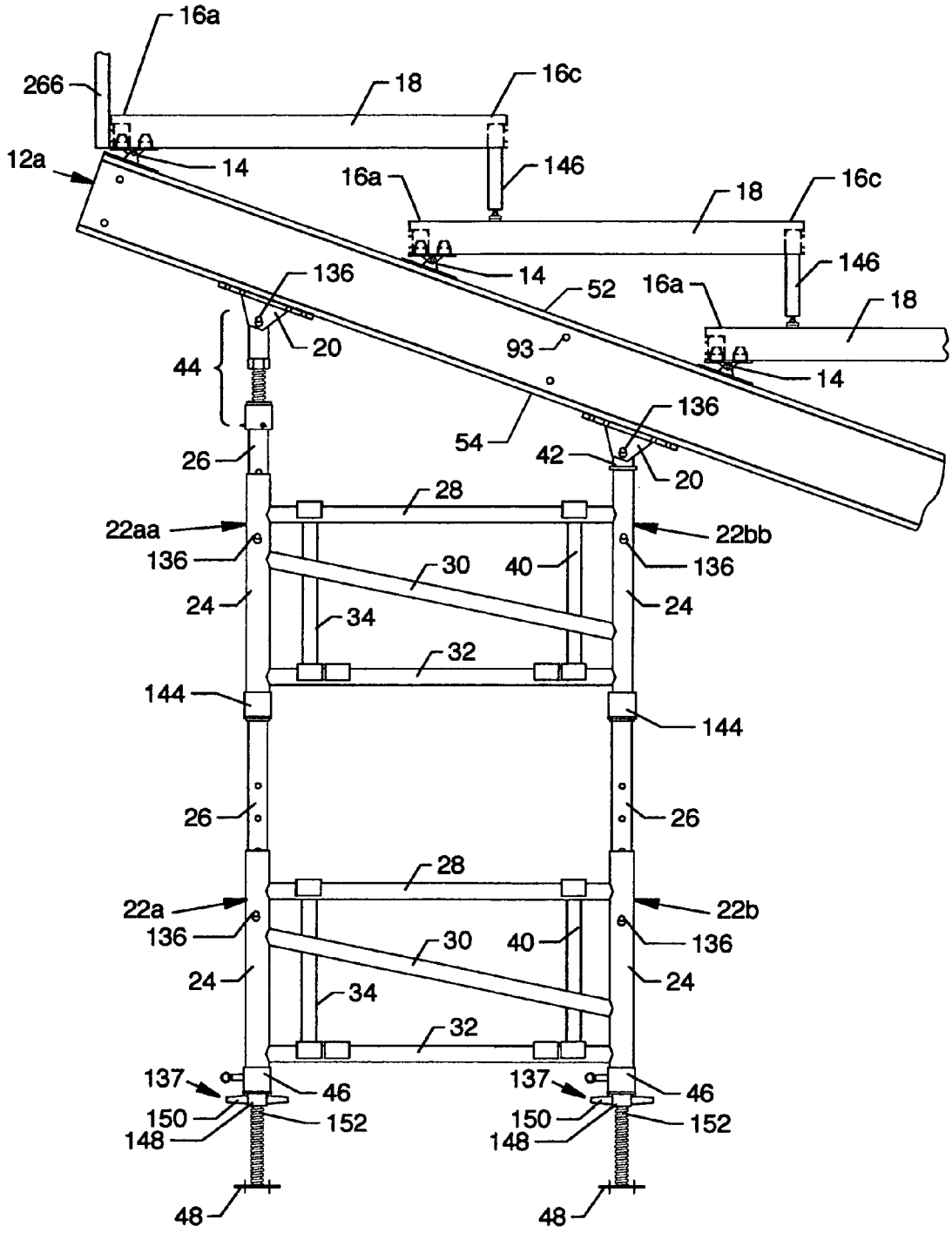
Figure 24:
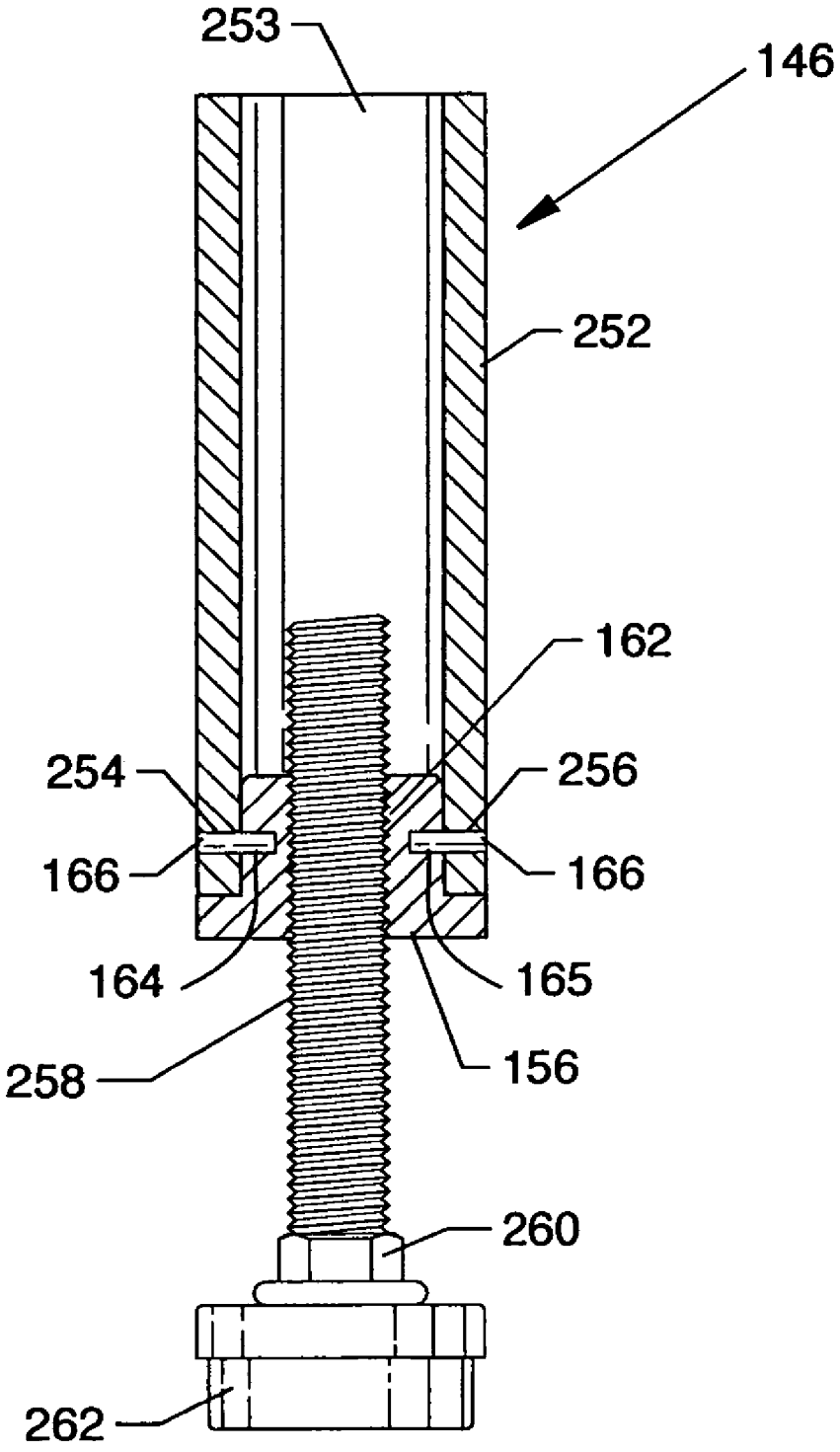
FIG. 24 is a cross section view of one of the adjustable foot support posts previously shown in use in FIGS. 11 and 12.

FIG. 1 is an isometric view of a multipurpose adjustable panel system 10, the present invention. Central to the invention are geometrically configured symmetrically shaped beams 12*a* and 12*b* aligned in opposition, the beams 12*a* and 12*b* and closely associated fixtures being capable of orientation and utilization in more than one angular or inclined position at different pitches and/or in various combinations to provide for maximum usefulness incorporating the components of the multipurpose adjustable panel system. Also central to the invention are a plurality of like pivotable panel support node fixtures 14 which are slidingly positionable along and fixably engaged in slots in the upper regions of the beams 12*a* and 12*b*, as later described in detail. Node receptor fixtures, shown later in detail, located under the corners 16*a* and 16*b* of a plurality of platform panels 18, align to the appropriate pivotable panel support node fixtures 14 in the slots in the upper regions of the beams 12*a* and 12*b*. Adjustable foot support posts, shown in FIGS. 11, 12 and 24, are located under the corners 16*c* and 16*d* of the platform panels 18. The platform panels 18 can be constructed according to the teachings regarding composite lightweight construction set forth in connection with those panels disclosed in U.S. Pat. No. 5,935,675 held by the assignee, and can include multiple recesses located on each platform panel underside for alignment to platform panel support nodes. Also central to the invention are a plurality of like pivotable beam support fixtures 20 which are slidingly positionable along and fixedly engaged in slots in the lower regions of the beams 12*a* and 12*b*, as later described in detail. Rearwardly placed and forwardly placed groups of support post assemblies 22*a*, 22*b*, 22*c* and 22*d* having vertical adjustability are incorporated for support of the beams 12*a* and 12*b* and associated overlying components. The support post assemblies 22*a*, 22*b*, 22*c* and 22*d* are similarly constructed, each including a stationary support post 24 and a positionable support post 26 slidingly accommodated within the stationary support post 24 and positionally fixed therein by the use of locking pins extending therethrough. Preferably, the stationary support posts 24 and the adjustable support posts 26, as well as other closely related or connected components, are fabricated of, but not limited to, round tubular aluminum or other suitable lightweight material; but the use of other shapes of support posts and other closely related or connected components is within the scope of the invention. Interconnect tubes 28, 30 and 32 secure and extend between the stationary support posts 24 of the support post assemblies 22*a* and 22*b*, and like interconnect tubes 28, 30 and 32 secure and extend between the stationary support posts 24 of the support post assemblies 22*c* and 22*d*. Cross braces 34, 36, 38 and 40, having end couplers, extend and secure between the interconnect tubes 28 and 32 of the support post assemblies 22*a* and 22*b* and the support post assemblies 22*c* and 22*d*, as shown. Various connectors and other closely associated components, including, but not limited to, fixed connectors 42, adjustable connectors 44, and screw jack connectors 46, shown in FIG. 1, are also shown in FIG. 11 and following figures in close and various associations with the upper ends of the positionable support posts 26 and/or with the lower ends of the stationary support posts 24.

Figure 2:
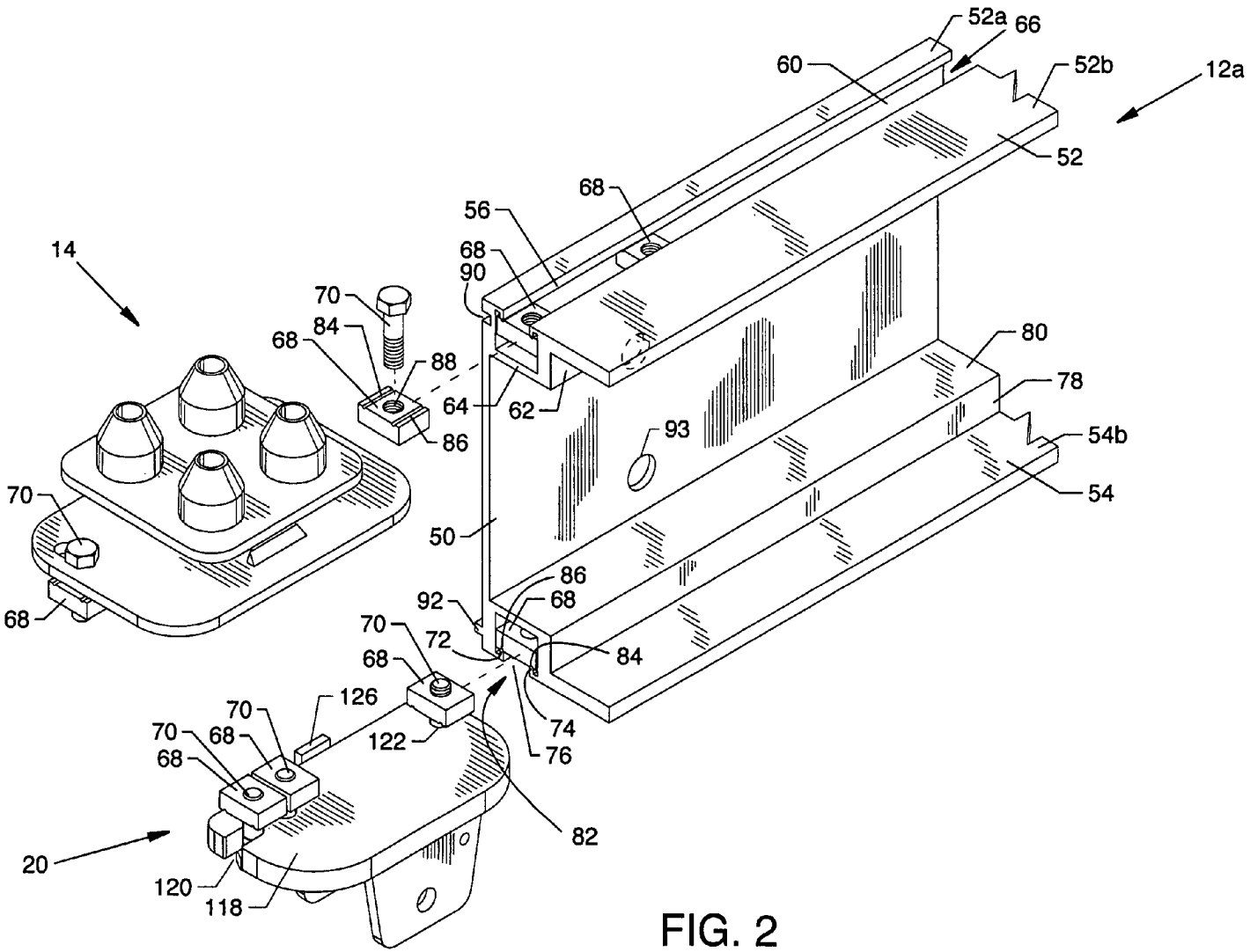
FIG. 2 is an isometric view of one end of a beam, a pivotable panel support node fixture aligned with the upper portion of the beam, a pivotable beam support fixture aligned with the lower portion of the beam.
Figure 3:
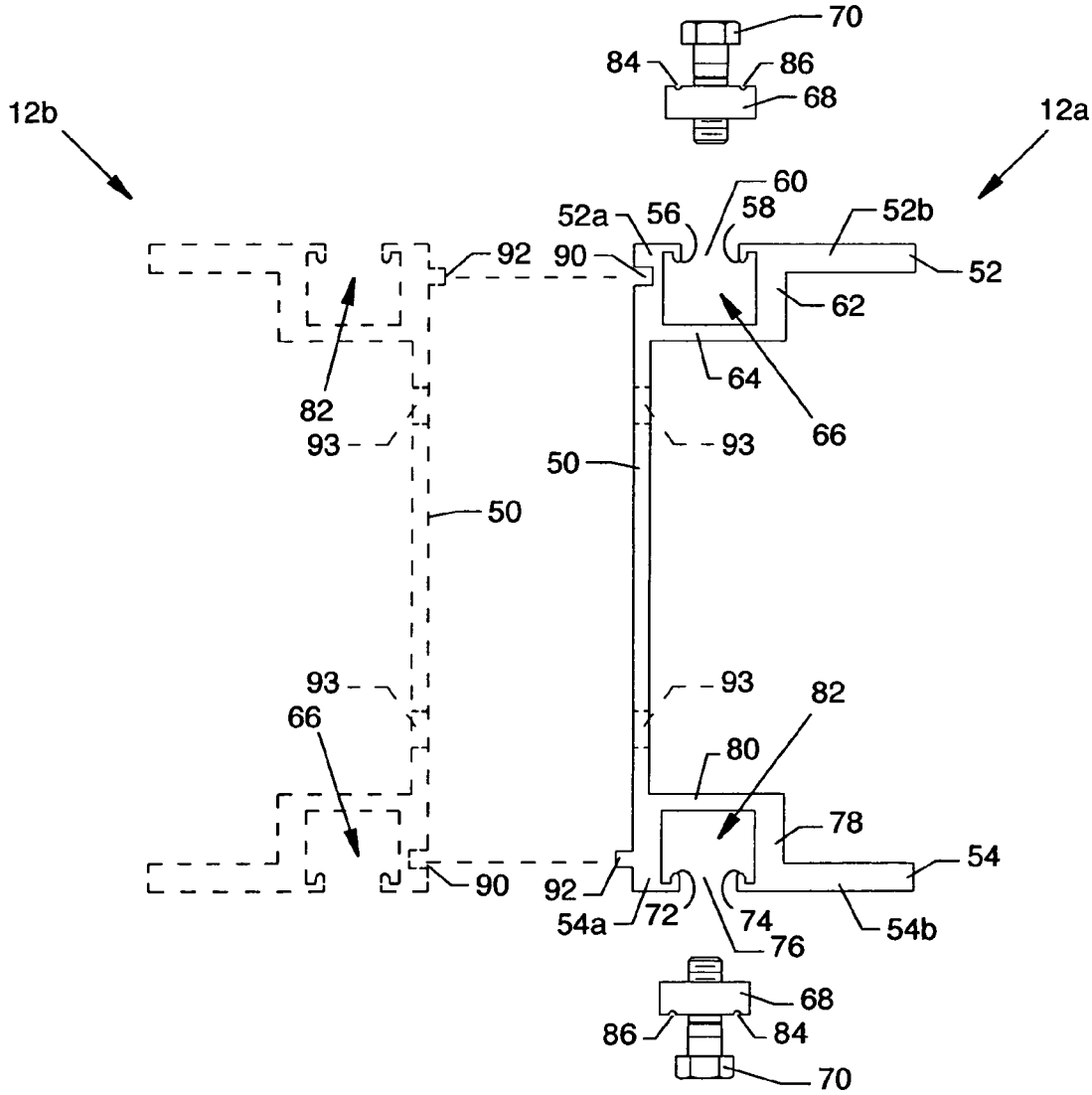
FIG. 3 is an end view showing one beam in solid lines and a similarly constructed beam in dashed lines.
Figure 10:
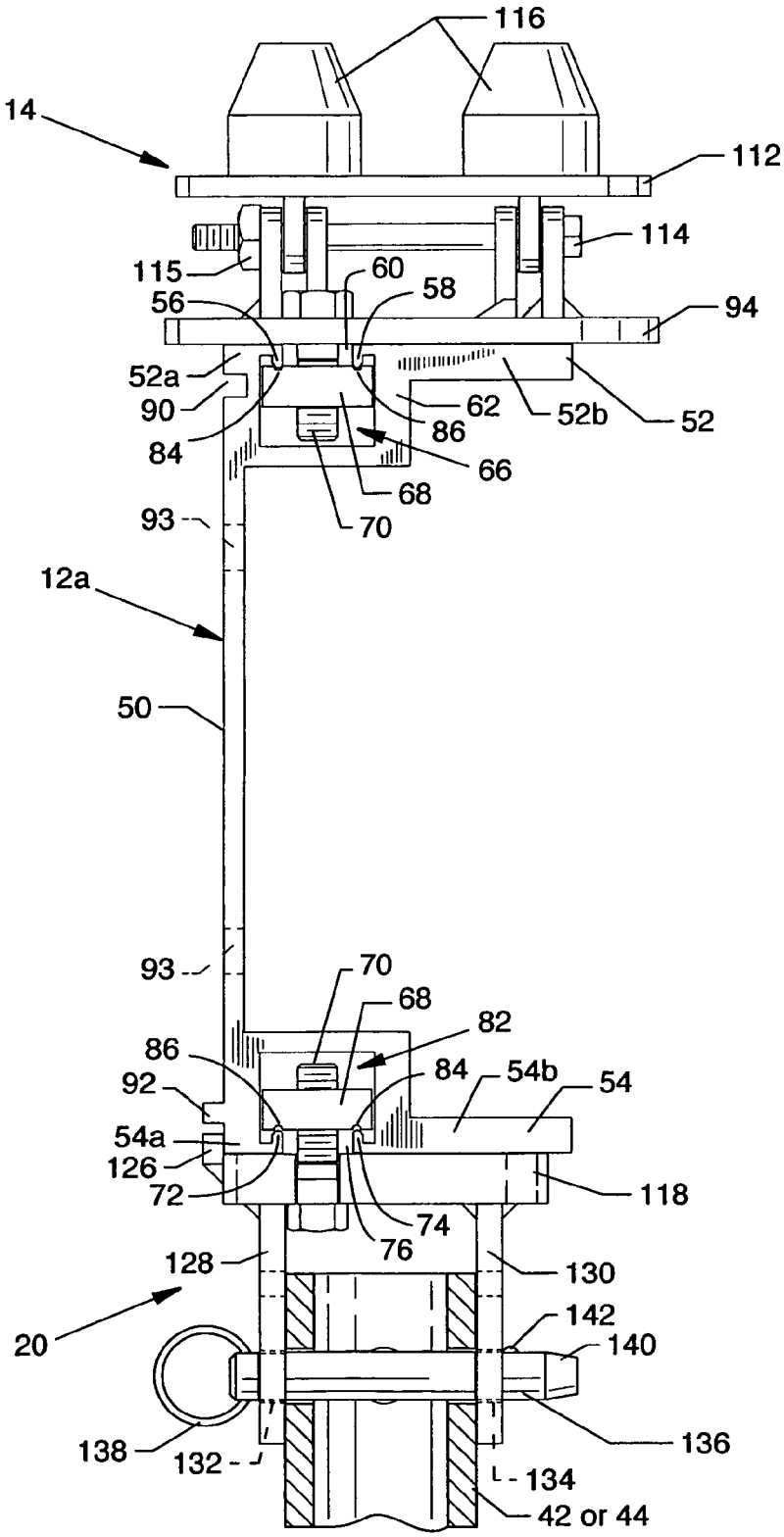
FIG. 10 is an end view of a beam showing the engagement of a pivotable panel support node fixture and a pivotable beam support fixture thereto.

FIG. 2 is an isometric view of one end of the beam 12*a*, a pivotable panel support node fixture 14 aligned with the upper portion of the beam 12*a*, and a pivotable beam support fixture 20 aligned with the lower portion of the beam 12*a*; and FIG. 3 is an end view showing the beam 12*a* in solid lines and the beam 12*b* in dashed lines. With reference to FIG. 2 and FIG. 3, the features of the beam 12*a* having the same features as beam 12*b* are now described. The beam 12*a*, preferably extruded of a lightweight material such as, but not restricted to, aluminum, includes a panel 50 and bifurcated support panels 52 and 54 extending perpendicularly from the top and bottom of the panel 50. The bifurcated support panel 52 includes a panel section 52*a* and a panel section 52*b* separated by a contact track 56 at one edge of the panel section 52*a*, a contact track 58 at one edge of the panel section 52*b* in opposition to the contact track 56, and a space 60 between the contact tracks 56 and 58. A panel 62 intersects and extends perpendicularly from the panel section 52*b* from a location in close proximity to the contact track 58 to intersect a panel 64 which extends perpendicularly from the panel 50. A geometrically configured slot 66 is formed by close association of the contact track 58, the panel 62, the panel 64, the upper portion of the panel 50, the contact track 56, and the space 60 for accommodation of one or more unistrut nuts 68 and accompanying bolts 70 which are incorporated to secure the pivotable panel support node fixtures 14 along the slot 66. Correspondingly and in mirror-like image with respect to the components forming or associated with the slot 66, another slot 82 is located in opposition to the slot 66. The bifurcated support panel 54 includes a panel section 54*a* and a panel section 54*b* separated by a contact track 72 at one edge of the panel section 54*a*, a contact track 74 at one edge of the panel section 54*b* in opposition to the contact track 72, and a space 76 between the contact tracks 72 and 74. A panel 78 intersects and extends perpendicularly from the panel section 54*b* from a location in close proximity to the contact track 74 to intersect a panel 80 which extends perpendicularly from the panel 50. The geometrically configured slot 82 is formed by close association of the contact track 74, the panel 78, the panel 80, the lower portion of the panel 50, the contact track 72, and the space 76 for accommodation of one or more unistrut nuts 68 and accompanying bolts 70 which are incorporated to secure the pivotable beam support fixtures 20 along the slot 82. The unistrut nuts 68 include parallel aligned grooves 84 and 86 on one surface and a centrally located threaded hole 88 for threaded accommodation of the bolts 70. The parallel aligned grooves 84 and 86 of the unistrut nuts 68 intimately and frictionally engage the contact tracks 56 and 58 of the slot 66 by the tightening action of the bolts 70 extending through the pivotable panel support node fixture 14 in order to secure the pivotable panel support node fixture 14 to the bifurcated support panel 52 of the beam 12*a* or 12*b*, as shown in FIG. 10. In a similar fashion, the parallel aligned grooves 84 and 86 of the unistrut nuts 68 intimately and frictionally engage the contact tracks 72 and 74 of the slot 82 by the tightening action of the bolts 68 extending through the pivotable beam support fixture 20 in order to secure the pivotable beam support fixture 20 to the bifurcated support panel 54 of the beam 12*a* or 12*b*, as shown in FIG. 10. Alternatively, the last thread at the extreme end of each bolt 70 may be purposely damaged after suitable extension through the holes 88 of the unistrut nuts 68 to prevent mutual separation in order to keep such components together as required. A groove 90 extends inwardly along the junction of the panel 50 and the panel section 52*a* of the bifurcated support panel 52 in close proximity to the slot 66, and a projection 92 extends outwardly from and along the outer face of the panel 50 near the junction of the panel 50 and the panel section 54*a* in close proximity to the slot 82.

FIG. 3 is an end view showing in solid lines the beam 12*a* and in dashed lines a similarly constructed beam 12*b* positioned to be accommodatingly mated to the beam 12*a*. It is to be noted that formations similar to tongue and groove constructions can be utilized to position the beams. For example, groove 90 of the beam 12*a* can be accommodated by and aligned about the projection 92 of the beam 12*b*, and the groove 90 of the beam 12*b* can be accommodated by and aligned about the projection 92 of the beam 12*a* when the vertically aligned panels 50 of the beams 12*a* and 12*b* are brought into and secured in intimate contact. A plurality of holes 93 are located along the panels 50 for fastening of the beams 12*a* and 12*b* together, as required. Such an option makes such a combination useful for heavy loading, if required, and is also useful in related applications of the components of the invention for use as described later in detail with reference to FIGS. 29, 30, 31, 32 and 33.

Figure 4:
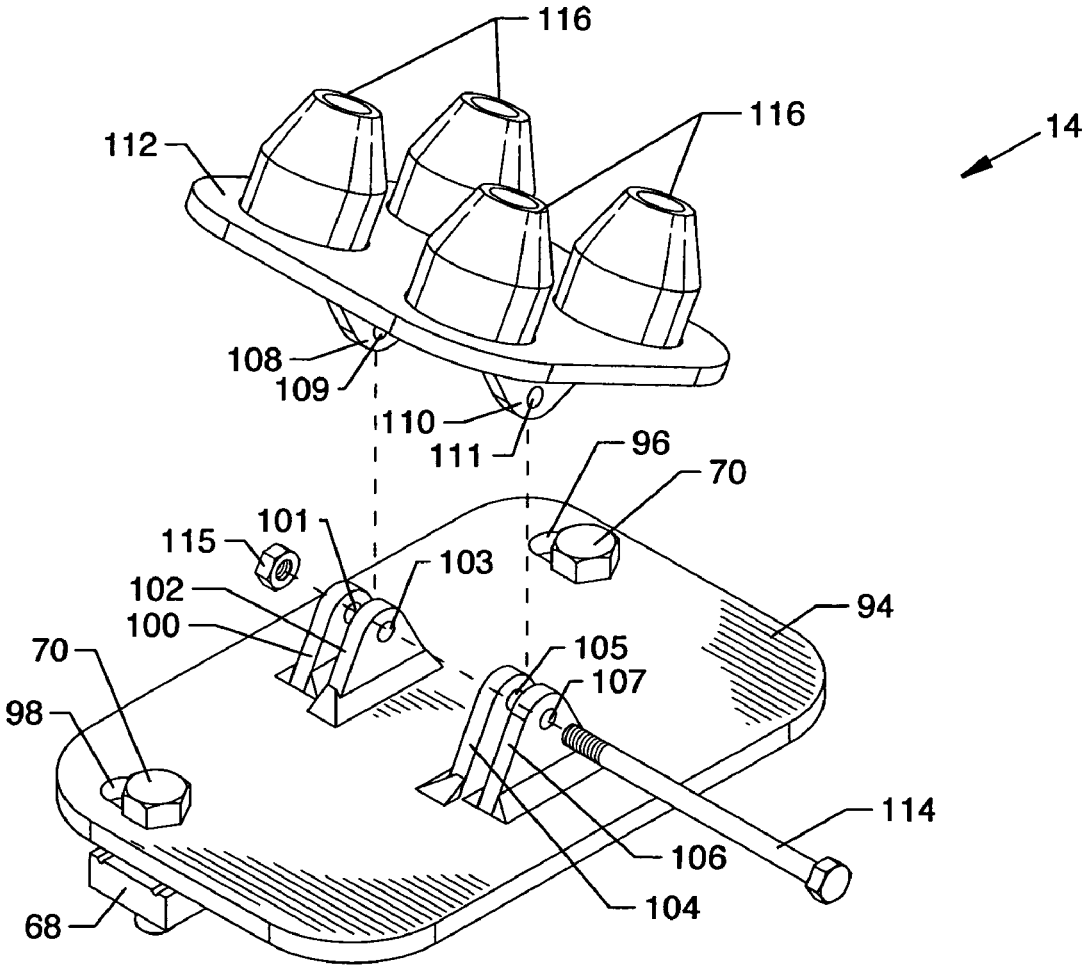
FIG. 4 is an isometric view of a pivotable panel support node fixture.
Figure 5:
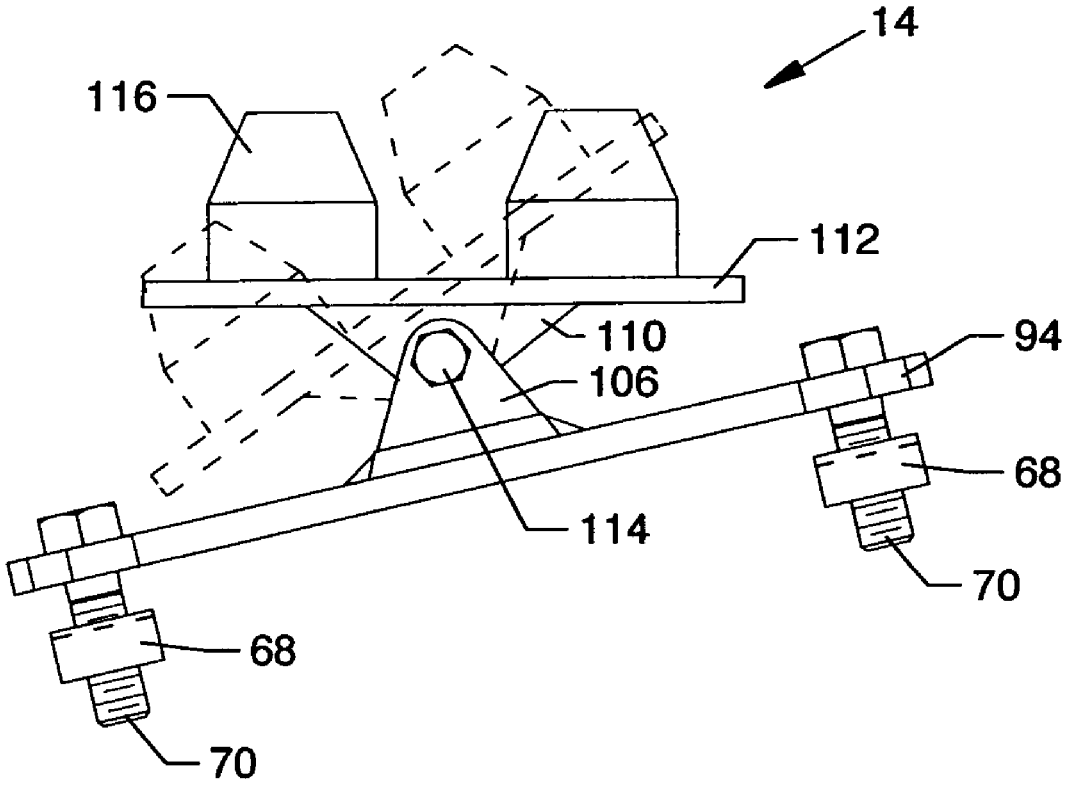
FIG. 5 is a side view of a pivotable panel support node fixture.
Figure 6:
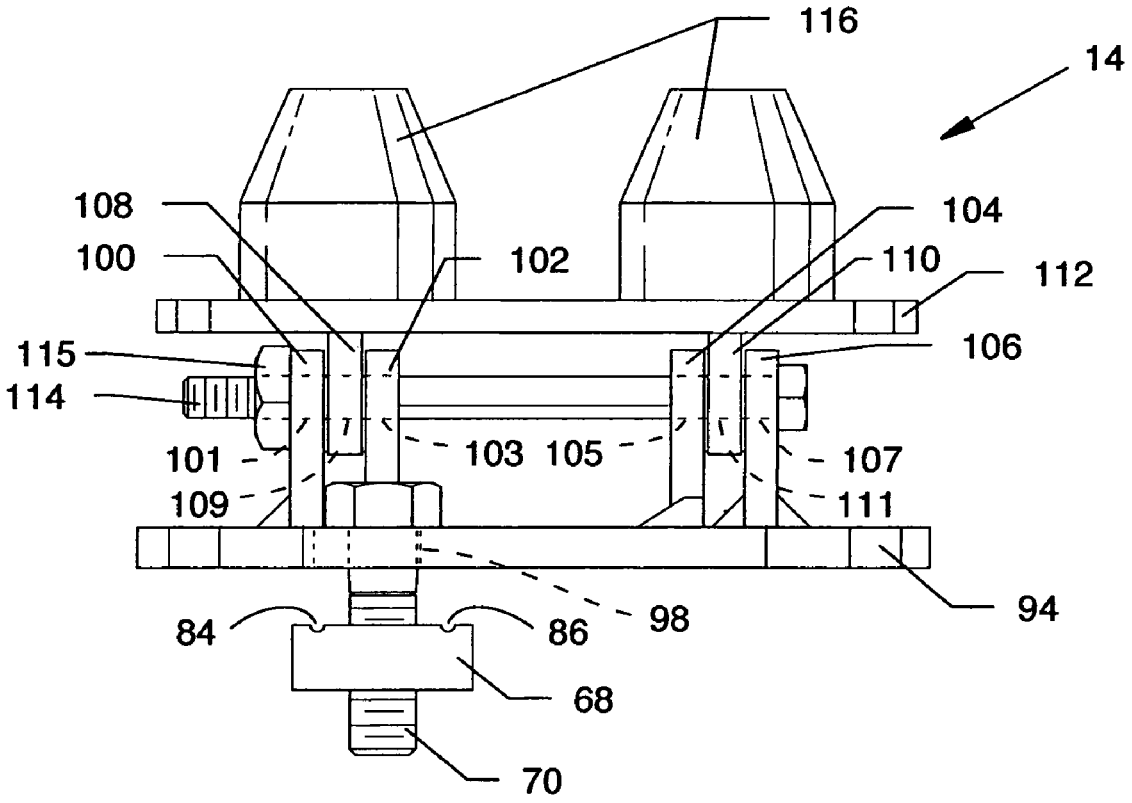
FIG. 6 is an end view of a pivotable panel support node fixture.

FIG. 4 is an isometric view of a pivotable panel support node fixture 14; FIG. 5 is a side view of the pivotable panel support node fixture 14; and FIG. 6 is an end view of the pivotable panel support node fixture 14. With reference to FIGS. 2, 4, 5 and 6, the pivotable panel support node fixture 14 is further described. The pivotable panel support node fixture 14 includes a baseplate 94 having elongated holes 96 and 98 offset from the center thereof for accommodation of bolts 70 which are used to engage unistrut nuts 68 to the underside of the baseplate 94. Spaced and paired pivot mounts 100 and 102 having holes 101 and 103, respectively, and spaced and paired pivot mounts 104 and 106 having holes 105 and 107, respectively, are secured such as by welding to the upper midportion of the baseplate 94. Pivot plates 108 and 110 having holes 109 and 111, respectively, are secured such as by welding to the underside of a node plate 112 in interspersed alignment between the spaced and paired pivot mounts 100 and 102 and spaced and paired pivot mounts 104 and 106. A pivot bolt 114 extends through holes 101 and 103 in the spaced and paired pivot mounts 100 and 102, through holes 105 and 107 in the spaced and paired pivot mounts 104 and 106, and through holes 109 and 111 in the pivot plates 108 and 110 to pivotally connect the baseplate 94 to the node plate 112. A nut 115 is included for engagement of the threaded end of the pivot bolt 114. A plurality of support nodes 116 are suitably located and fastened to the upper side of the node plate 112. The pivotable panel support node fixtures 14 can be slidingly positioned along the bifurcated support panel 52, wherein the slot 66 of the beam 12*a* or 12*b* offers guidance therealong using the unistrut nuts 68 and bolts 70 to track along the slot 66. When at the desired position along the bifurcated support panel 52, the unistrut nuts 68 and bolts 70 can be tightened to positionally secure the pivotable panel support node fixtures 14 to the bifurcated support panel 52 of the beam 12*a* or 12*b*. The node plate 112, including the plurality of support nodes 116, is free to rotate about the pivot bolt 114, as demonstrated in FIG. 5, thereby accommodating angular differences between the pitch of the beams 12*a* and 12*b*, which can be different in various configurations, and the preferably level pitch of the platform panels 18.

Figure 7:
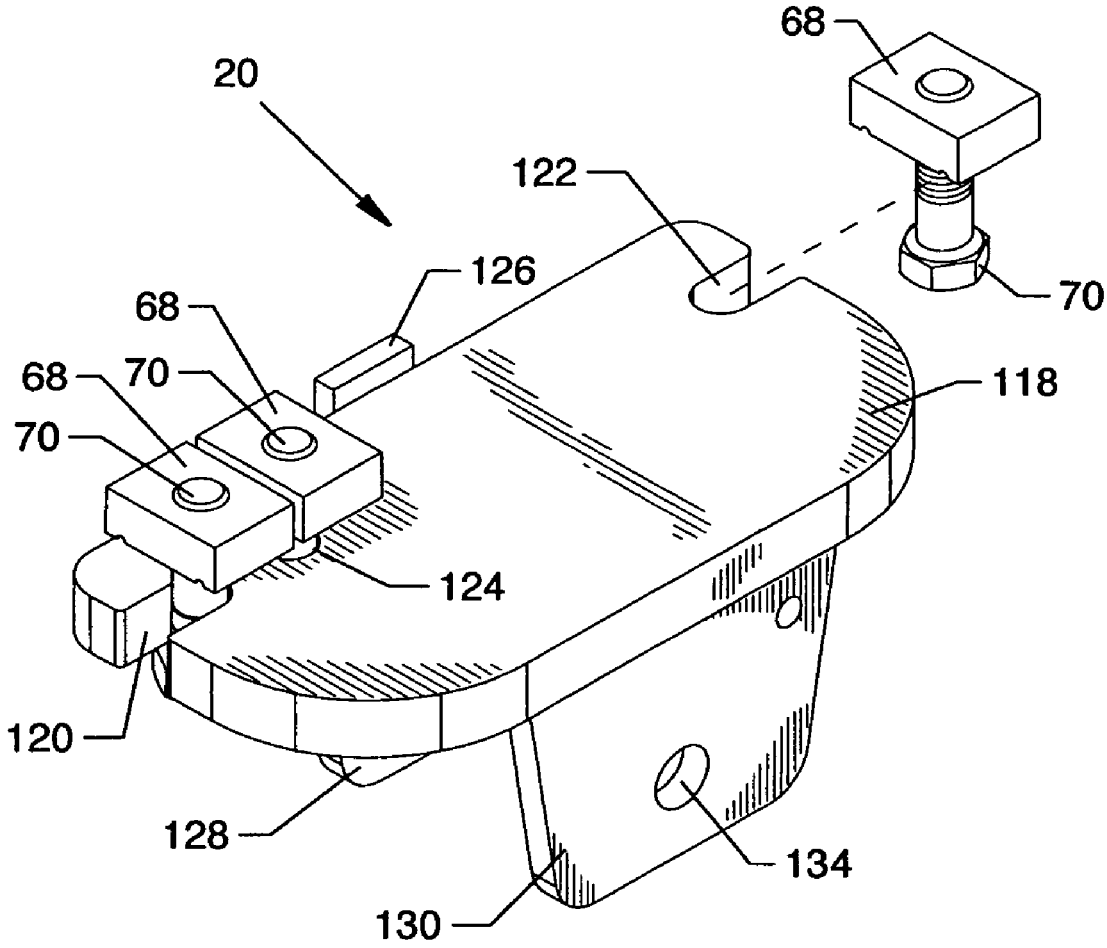
FIG. 7 is an isometric view of a pivotable beam support fixture.
Figure 8:
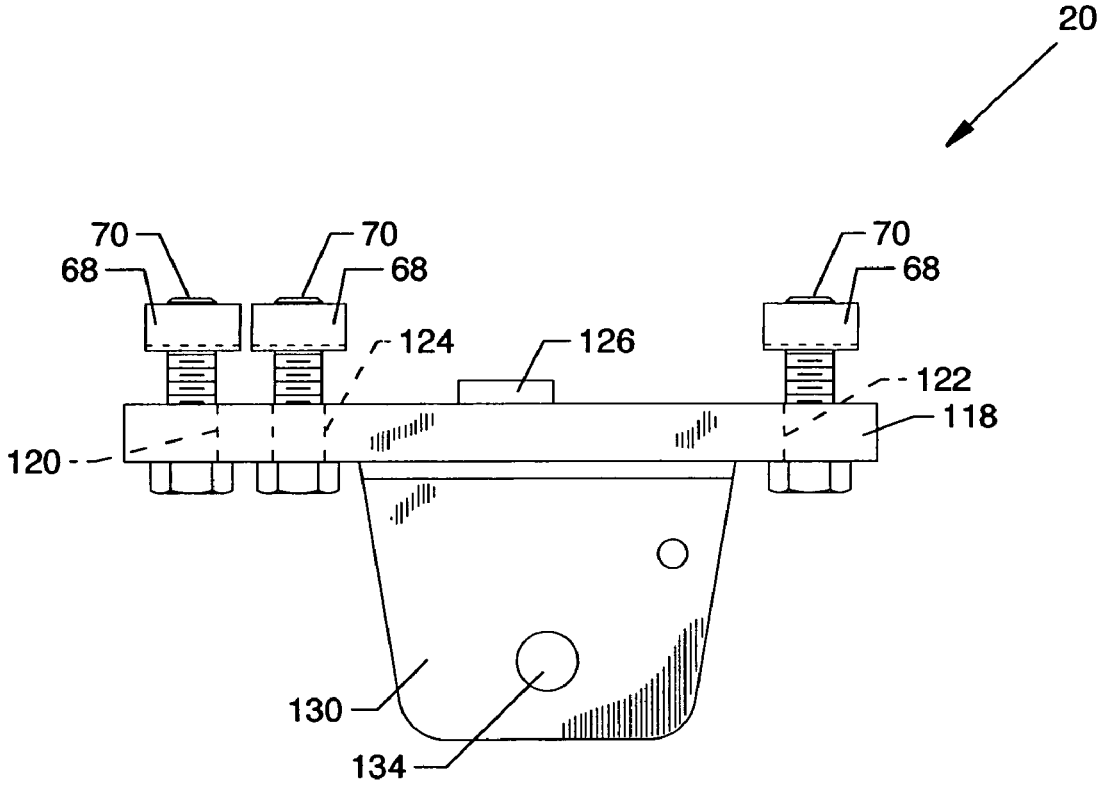
FIG. 8 is a side view of a pivotable beam support fixture.
Figure 9:
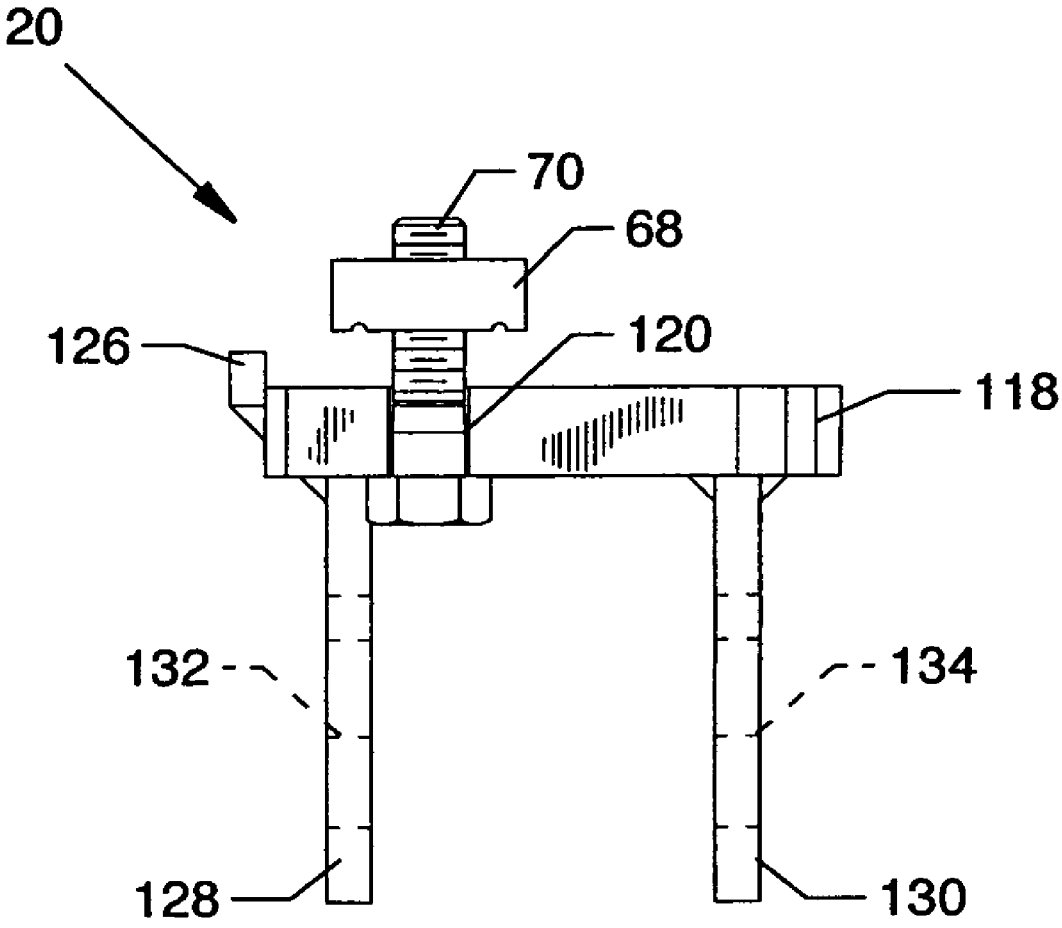
FIG. 9 is an end view of a pivotable beam support fixture.

FIG. 7 is an isometric view of a pivotable beam support fixture 20; FIG. 8 is a side view of the pivotable beam support fixture 20; and FIG. 9 is an end view of the pivotable beam support fixture 20. With reference to FIGS. 2, 7, 8 and 9, the pivotable beam support fixture 20 is further described. The pivotable beam support fixture 20 includes a baseplate 118 having slots 120 and 122 at opposing edges and a hole 124, wherein the slots 120 and 122 and the hole 124 are offset from the center thereof and utilized for accommodation of bolts 70 used to fasten unistrut nuts 68 to the upperside of the baseplate 118. A bolt 70 extends through the hole 124 and through the threaded hole 88 of the unistrut nut 68 to position the unistrut nut 68 on the upperside of the baseplate 118 for subsequent accommodation by the slots 82 of the beams 12*a* and 12*b*. Bolts 70 extend accommodatingly through the slots 120 and 122 for the same purpose after gaining direct access vertically through the slots 120 and/or 122 or after gaining sideways or sliding entry into the slots 120 and/or 122 to pass through the threaded holes 88 of the associated unistrut nuts 68 to position the unistrut nuts 68 on the upperside of the baseplate 118 for subsequent accommodation by the slots 82 of the beams 12*a* and 12*b*. Such an arrangement using the slots 120 and 122 allows for sliding versatility during initial positioning of the pivotable beam support fixture 20, as desired, to minimize jamming of the unistrut nuts 68 within the slots 82 of the beams 12*a* and 12*b*. For purposes of example and illustration, the outboard unistrut nuts 68 and accompanying bolts 70 can be positioned in the slots 82 on both sides of, but not engaged within, the slots 120 and 122 of the baseplate 118. The pivotable beam support fixture 20 can be slidingly positioned along the bifurcated support panel 54 of the beam 12*a* or 12*b* using the single unistrut nut 68 and bolt 70 aligned to the hole 124 to track along the slot 82. When at the desired position along the slot 82, the adjacently positioned unistrut nuts 68 and bolts 70 can be repositioned within and along the slot 82 to cause the bolts 70 to enteringly engage the slots 120 and 122 in the baseplate 118, whereupon all the unistrut nuts 68 and bolts 70 can be tightened to positionally secure the pivotable beam support fixture to the bifurcated support panel 54 of the beam 12*a* or 12*b*. A guide bar 126 is also included at the outboard edge of the baseplate 118. Opposed pivot mounts 128 and 130 having pivot holes 132 and 134, respectively, are suitably secured such as by welding to the underside of the baseplate 118 for subsequent pivoted connection to the top of an adjustable connector 44 or fixed connector 42 at the upper regions of support post assemblies 22*a*-22*d*.

FIG. 10 is an end view of the beam 12*a* showing the engagement of a pivotable panel support node fixture 14 and a pivotable beam support fixture 20 thereto. Shown in particular is the relationship of the pivotable panel support node fixture 14 to the bifurcated support panel 52, wherein the baseplate 94 of the pivotable panel support node fixture 14 is in intimate, supported and secured contact with the bifurcated support panel 52. Prior to securing of the pivotable panel support node fixture 14 to the bifurcated support panel 52, the pivotable panel support node fixture 14 is positioned, as desired, along the bifurcated support panel 52, during which time the shafts of the bolts 70 are slidingly accommodated by and traverse along the space 60 between the contact tracks 56 and 58 and a portion of the slot 66, and during which time the unistrut nut 68 is slidingly accommodated by and traverses along the slot 66. The shafts of the bolts 70 pass through the slotted holes 96 and 98 of the baseplate 94 to engage the threads of the threaded holes 88 of the unistrut nuts 68, and the heads of the bolts 70 engage the portion of the baseplate 94 surrounding the elongated holes 96 and 98. The sides of the unistrut nuts 68 are in close proximity with the panel 62 and an opposite portion of the panel 50 and are prevented from rotation during tightening by such an arrangement. During final tightening of the bolts 70 and unistrut nuts 68, the grooves 84 and 86 of the unistrut nuts 68 are brought into forcible frictional engagement with the contact tracks 56 and 58, respectively, thereby forcing the baseplate 94 of the pivotable panel support node fixture 14 into supported frictional engagement with the bifurcated support panel 52, thereby providing stable and locked engagement thereto. The baseplate 118 of the pivotable beam support fixture 20 enjoys a similar and closely related association, wherein the bolts 70 and unistrut nuts 68 are utilized in a fashion as just described and as previously described collectively with respect to FIGS. 7, 8 and 9 to force the baseplate 118 of the pivotable beam support fixture 20 into supported frictional engagement with the bifurcated support panel 54, thereby providing stable and locked engagement thereto. Also shown engaged between the pivot mounts 128 and 130 is the upper portion of a cylinder which could be a cylinder associated with the upper region of a fixed connector 42 or of an adjustable connector 44. Locking pins 136 having a grasping ring 138 on one end, a taper 140, and one or more spring-loaded detent balls 142 are incorporated throughout the system to secure cylindrical components to other cylindrical components or to other components of various constructions. One example is shown in FIG. 10 where the locking pin 136 passes through the holes 132 and 134 of the pivot mounts 128 and 130, respectively, as well as through opposed holes in a structure, such as, but not limited to, the upper (or other) region of a fixed connector 42 or of an adjustable connector 44, wherein the detent ball 142 extends beyond the outer portion of a hole and extends outwardly to ensure capture of the locking pin 136.

FIGS. 11 and 12 are side views of the structure supporting the beams 12*a* and 12*b* where the beams 12*a* and 12*b* are inclined or pitched, such as for use as support for seating; but the arrangement of all or most of the components can also result where the beams 12*a* and 12*b* are level instead of being inclined to provide level elevated or non-elevated platforms. More specifically, the location and interconnecting relationship of the components of the instant invention used in various inclined or pitched arrangements is shown in FIGS. 11 and 12. FIG. 11 shows elevation of one end of the beam 12*a* by a single level of support post assemblies 22*a* and 22*b* and closely associated components, such as, but not limited to, a pivotable beam support fixture 20 secured to the bifurcated support panel 54 on the underside of the beam 12*a*, as previously described, in alignment with an adjustable connector 44 secured to the pivotable beam support fixture 20, such as by a locking pin 136, the top of the positionable support post 26 of the support post assembly 22*a* being engaged and secured to the bottom of the adjustable connector 44, and the bottom of the positionable support post 26 shown telescopingly engaging and extending above the interior of the stationary support post 24 of the support post assembly 22*a* and secured therein by a locking pin 136, a screw jack 137 comprised of a screw jack connector 46 secured to the bottom of the stationary support post 24, a screw jack boss 148 including a screw jack adjustment handle 150 engaging the bottom of the screw jack connector 46, a screw jack threaded shaft 152 threadingly engaging the screw jack boss 148 and extending freely into the lower interior of the stationary support post 24, and a baseplate 48 suitably attached to the bottom of the screw jack threaded shaft 152. The support post assembly 22*b* and closely associated components are arranged and constructed in a similar fashion to the support post assembly 22*a* and closely associated components but include a fixed connector 42 at the upper end of the positionable support post 26 in lieu of the adjustable connector 44. The support post assemblies 22*a* and 22*c* and closely associated components are arranged and constructed in a fashion similar to one another and the support post assemblies 22*b* and 22*d* and closely associated components are arranged and constructed in a fashion similar to one another.

The pivotable panel support node fixtures 14 are shown secured to the bifurcated support panel 52 at the upper portion of the beam 12*a*, wherein support for the corners 16*a* of the platform panels 18 is provided by a node receptor fixture 154 located in the undersides of the corners 16*a*. Adjustable foot support posts 146, which can be of various lengths, secure opposite to the receptor fixtures 154 in the undersides of the corners 16*c* (and 16*d*). The adjustable foot support posts 146 are incorporated to provide adjustable support for one end of the platform panels 18.

FIG. 12 shows elevation of one end of the beam 12*a* at a greater pitch than that of the beam 12*a* shown in FIG. 11 by an additional level of support post assemblies like support post assemblies 12*a* and 12*b*, herein designated as support post assemblies 22*aa* and 22*bb*, and for the most, like closely associated components at a location stacked atop the support post assemblies 22*a* and 22*b* and closely associated components. In order to utilize the stationary support posts 24 of the support post assemblies 22*aa* and 22*bb*, the adjustable connectors 44 are removed from the tops of the positionable support posts 26 of the support post assemblies 22*a* and 22*b* and replaced by post connectors 144 which secure to the tops of the positionable support posts 26. The bottoms of the stationary support posts 24 of the support post assemblies 22*aa* and 22*bb*, devoid of any screw jack components, are accommodated by the post connectors 144 at the tops of the positionable support posts 26 of the support post assemblies 22*a* and 22*b*. Positional versatility is provided considering the adjustment along or in combination with the jack screws 137 at the lower ends of the stationary support posts 24, where applicable, the vertical stacking and adjustability of the support post assemblies 22*a*, 22*b*, 22*aa* and 22*bb* and other like assemblies, the vertical adjustability of the adjustable connectors 44, and the pivotability of the pivotable panel support node fixtures 14 and the pivotable beam support fixtures 20. Features of the connector devices are included and described in detail in connection with FIGS. 13-24.

Figure 13:
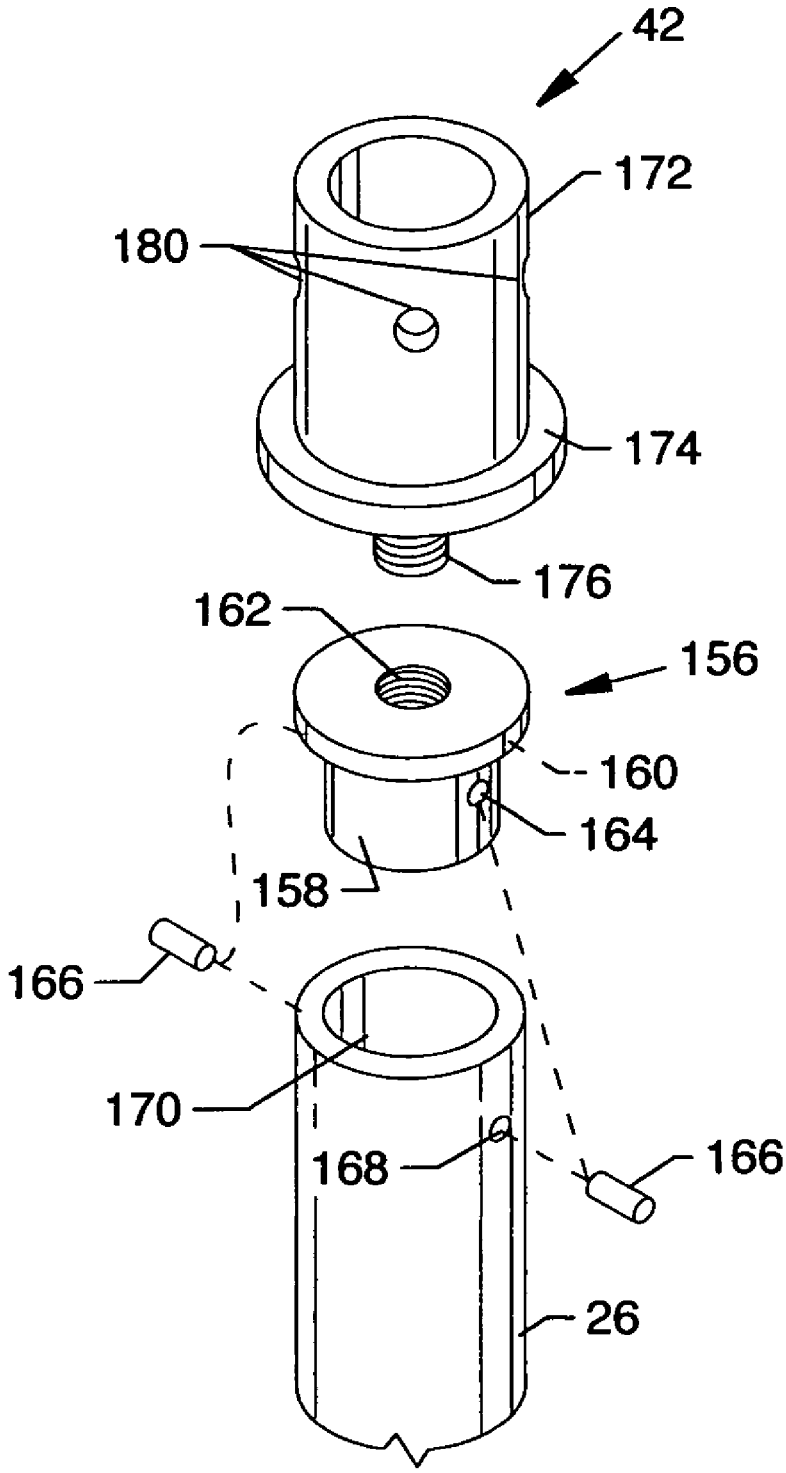
FIG. 13 is an exploded isometric view showing the relationship of a fixed connector and a threaded receptor socket to the upper region of a positionable support post.
Figure 14:
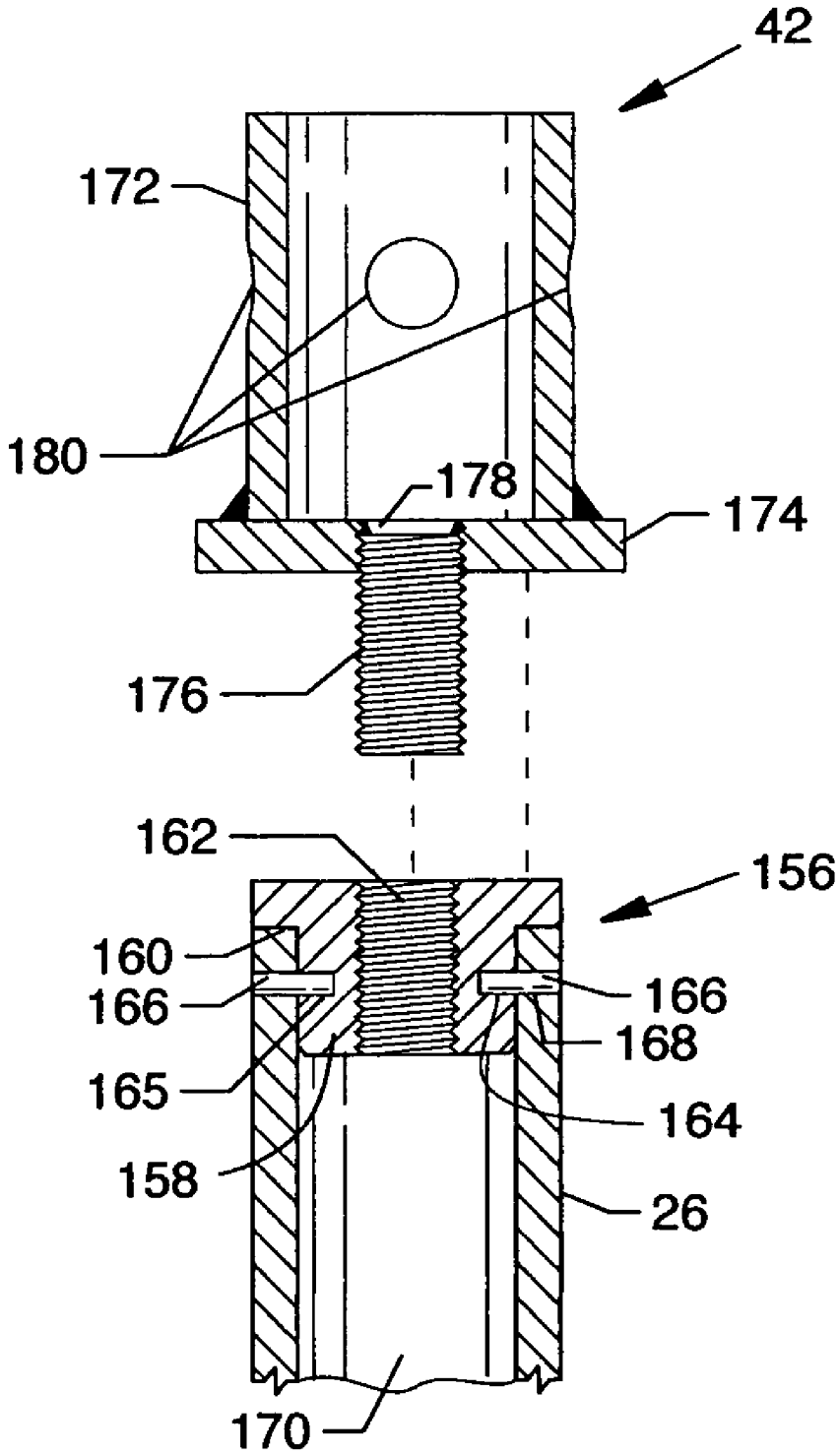
FIG. 14 is a partially exploded cross section view of the components of FIG. 13.
Figure 15:
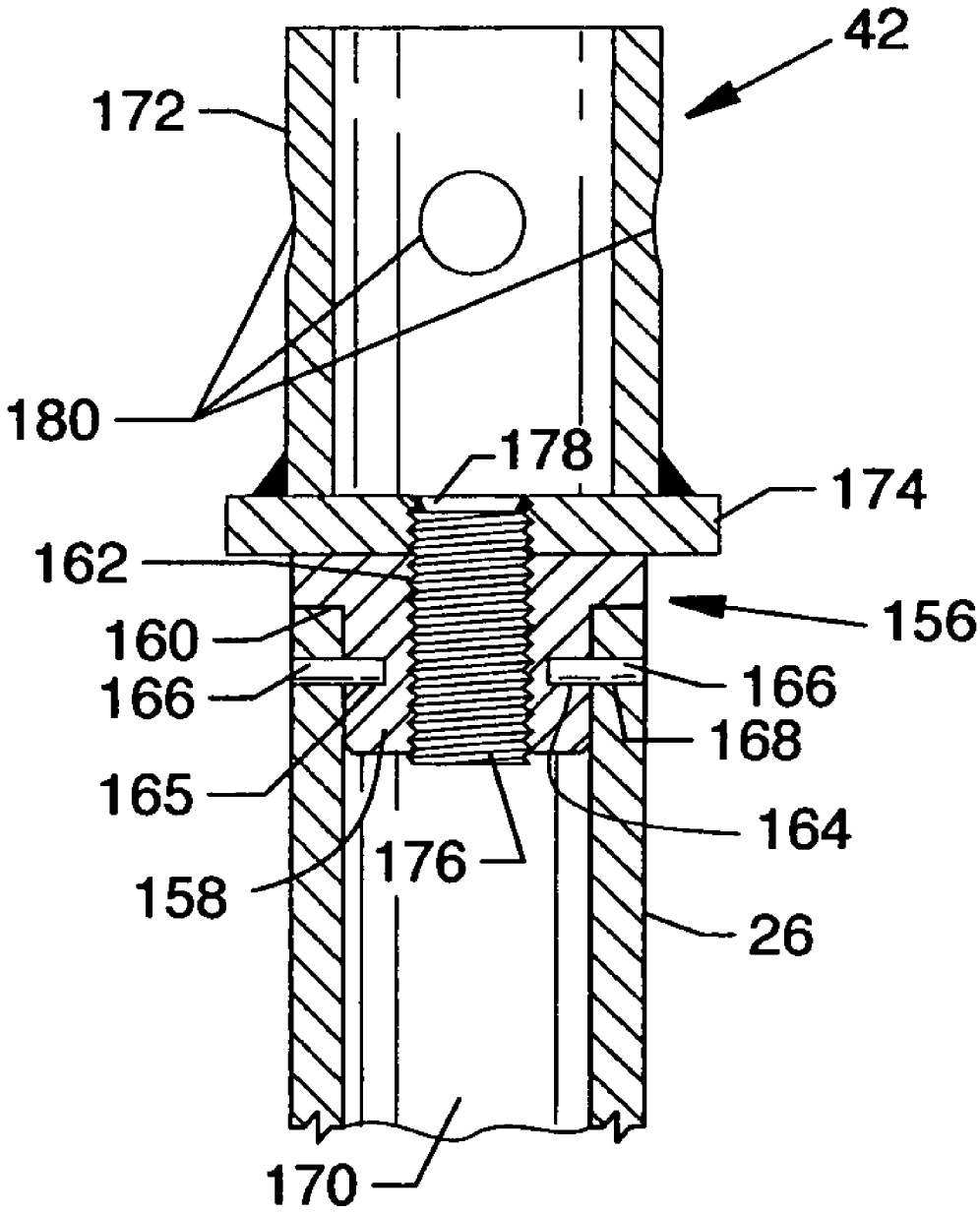
FIG. 15 is a cross section view showing engagement of a fixed connector by a threaded receptor socket in the top of a positionable support post.

FIG. 13 is an exploded isometric view showing the relationship of a fixed connector 42 and a threaded receptor socket 156 to the upper region of a positionable support post 26; FIG. 14 is a partially exploded cross section view of the components of FIG. 13; and FIG. 15 is a cross section view showing engagement of the fixed connector 42 by the threaded receptor socket 156 in the top of the positionable support post 26.

Each of the one-piece threaded receptor sockets 156 is of multiple radius construction, wherein a lesser radius plug 158 of cylindrical form extends from a larger radius annular shoulder 160. A centrally located threaded hole 162 aligns along the central axis. Transversely aligned holes 164 and 165 extend into the plug 158 short of the threaded hole 162 for partial accommodation of roll pins 166, and an interrupted transversely aligned hole 168 extends through the upper region of the positionable support post 26 in intersection with the bore 170 for partial accommodation of roll pins 166 in order to secure the threaded receptor socket 156 in the bore 170 of the upper region of the positionable support post 26. Each fixed connector 42 includes a cylinder 172 suitably secured, such as by welding, to a disk-shaped base 174. A threaded shaft 176 can be threaded into a threaded hole 178 in the disk-shaped base 174 or, alternatively, the threaded shaft 176 can be aligned within an unthreaded similarly located hole central to the disk-shaped base 174 and secured therein by welding or other suitable means. A plurality of transversely aligned and opposed holes 180 are included in the cylinder 172 for accommodation of a locking pin 136, such as when connected to the lower portion of a pivotable beam support fixture 20. In the alternative, the cylinder 172, the base 174, and the threaded shaft 176 could be combined using various combinations into a unitary one-piece structure. The threaded shafts 176 of the fixed connectors 42 engage the threaded holes 162 of the threaded receptor sockets 156 and are rotated to cause intimate and planar engagement of the bases 174 of the fixed connectors 42 to the tops of the threaded receptor sockets 156, thereby offering a suitable and stable association therebetween.

Figure 16:
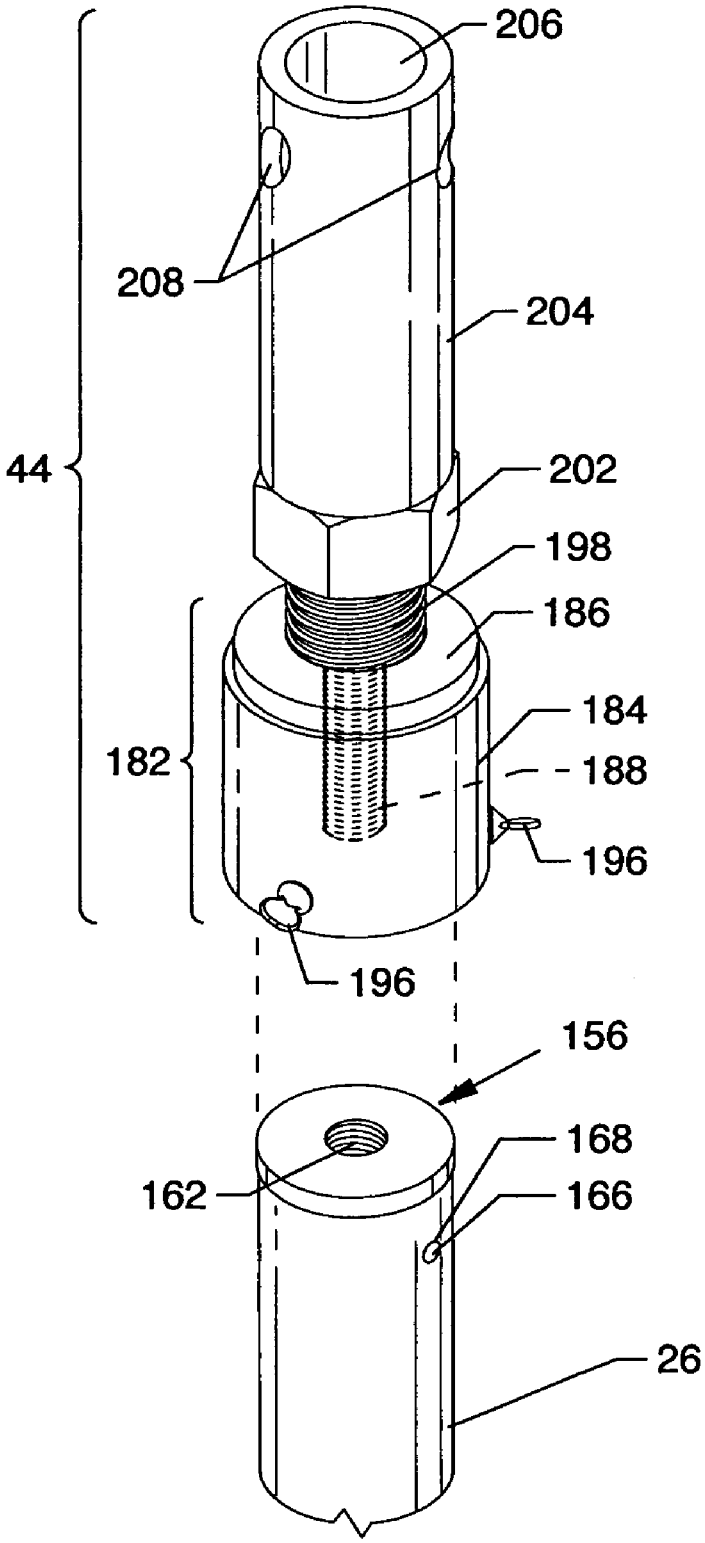
FIG. 16 is an isometric view showing the relationship of an adjustable connector and a threaded receptor socket to the upper region of a positionable support post.
Figure 17:
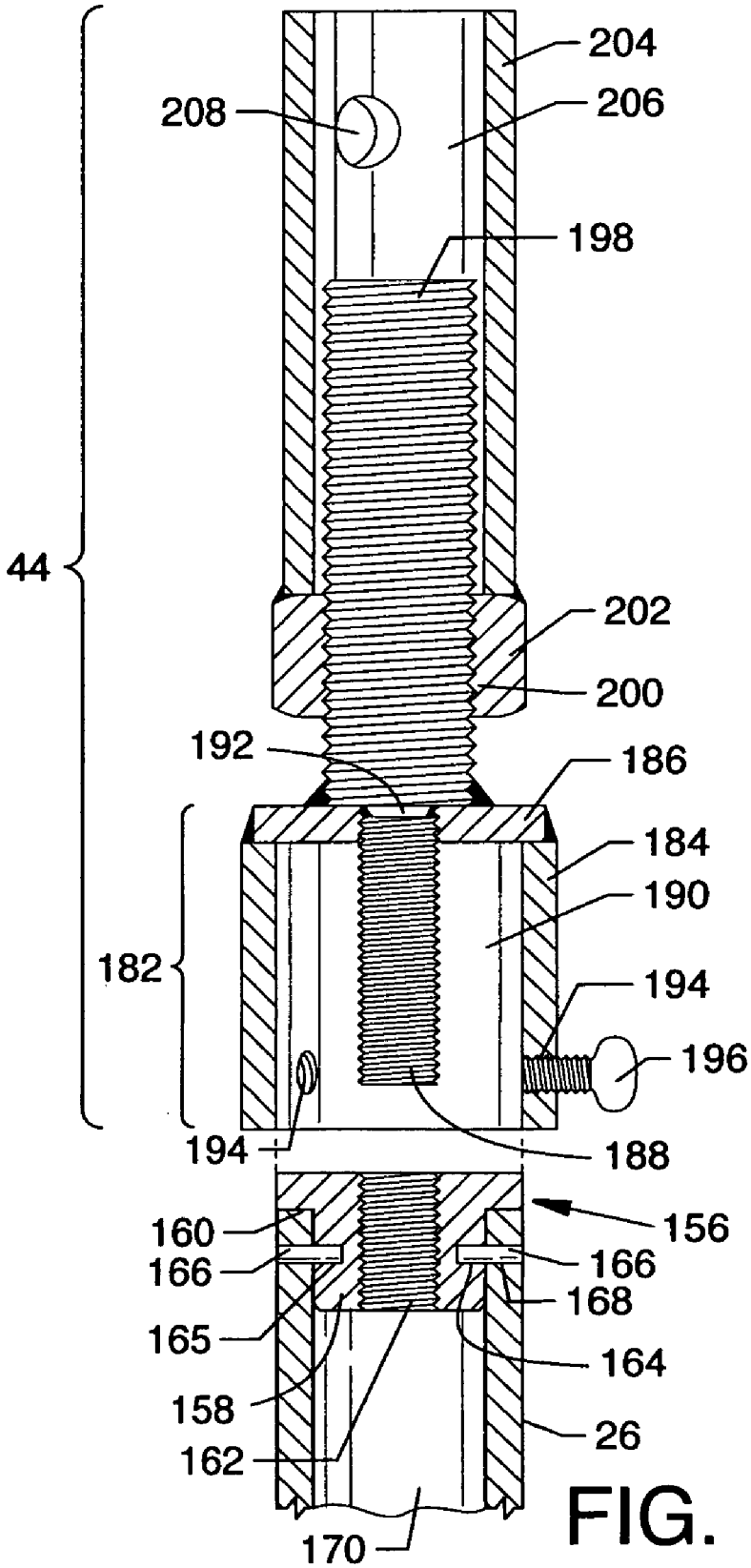
FIG. 17 is a partially exploded cross section view of the components of FIG. 16.
Figure 18:
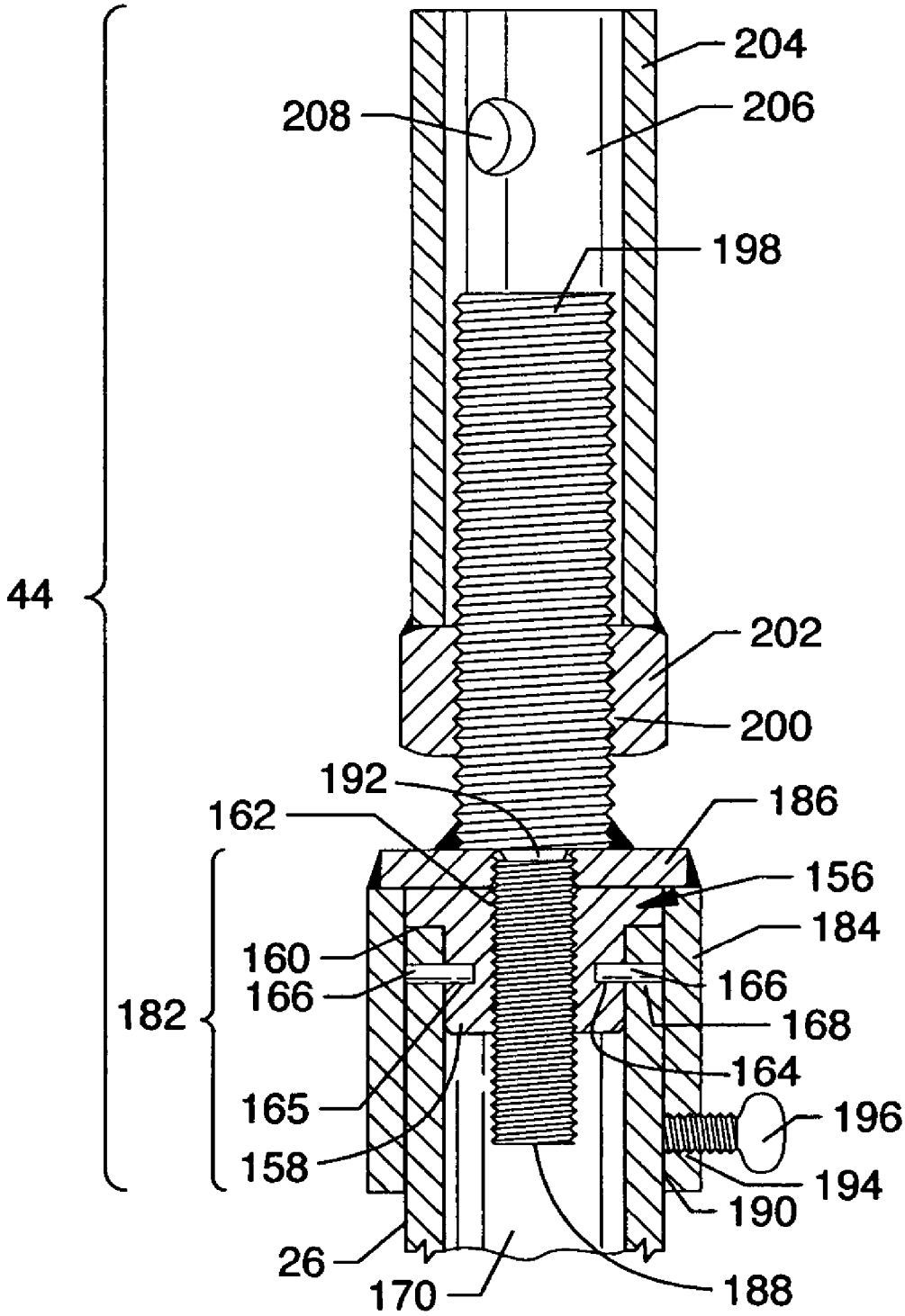
FIG. 18 is a cross section view showing engagement of an adjustable connector by a threaded receptor socket in the top of a positionable support post and by the top of the positionable support post.

FIG. 16 is an isometric view showing the relationship of an adjustable connector 44 and a threaded receptor socket 156 to the upper region of a positionable support post 26; FIG. 17 is a partially exploded cross section view of the components of FIG. 16; and FIG. 18 is a cross section view showing engagement of the adjustable connector 44 by the threaded receptor socket 156 in the top of the positionable support post 26 and by the top of the positionable support post 26.

The lower portion of each adjustable connector 44 includes a cap 182 having a cylinder 184, a circular plate 186 suitably secured, such as by welding, to the upper portion of the cylinder 184, and a threaded shaft 188. The threaded shaft 188, which extends into and along the centerline of the bore 190 of the cylinder 184, can be threaded into a threaded hole 192 in the circular plate 186 or, alternatively, the threaded shaft 188 can be aligned within an unthreaded similarly located hole central to the circular plate 186 and secured therein by welding or other suitable means. A plurality of threaded holes 194, distributed about the lower portion of the cylinder 184, accommodate a plurality of thumbscrews 196 which can rotatingly extend into the bore 190 to engage an upper portion of a positionable support post 26. A robust threaded shaft 198 is aligned along and about the centerline of the adjustable connector 44 and is suitably secured, such as by welding, to the outer planar surface of the circular plate 186 from which it extends to threadingly engage the threads 200 of a robust nut 202 suitably secured, such as by welding, to the lower region of a cylinder 204. The threaded shaft 198 extends beyond the nut 202 into the bore 206 of the cylinder 204. In the alternative, the components of the cap 182, including the cylinder 184, the circular plate 186, the threaded shaft 188, and additionally including the threaded shaft 198, could be combined using various combinations into a unitary one-piece structure. A plurality of transversely aligned and opposed holes 208 are included at the upper region of the cylinder 204 for accommodation of a locking pin 136, such as when connected to the lower portion of a pivotable beam support fixture 20. Use of the adjustable connectors 44 is initiated by placing the cap 182 portion of the adjustable connector 44 over the upper region of the combined threaded receptor socket 156 and top of the positionable support post 26 and rotating the cap 182 and connected components to cause the threaded shaft 188 to engage the threaded hole 162 of the threaded receptor socket 156, and thence continuing rotation to cause intimate and planar engagement of the circular plate 186 of the cap 182 with the top of the threaded receptor socket 156, thereby offering a suitable and stable well-connected association therebetween. In addition, the thumbscrews 196 can be rotated to engage an upper portion of the positionable support post 26 for additional stability and connection. The cylinder 204 is vertically and rotatably adjustable along and about the threaded shaft 198 in order to align to the lower portion of a pivotable beam support fixture 20 for suitable connection thereto.

Figure 19:
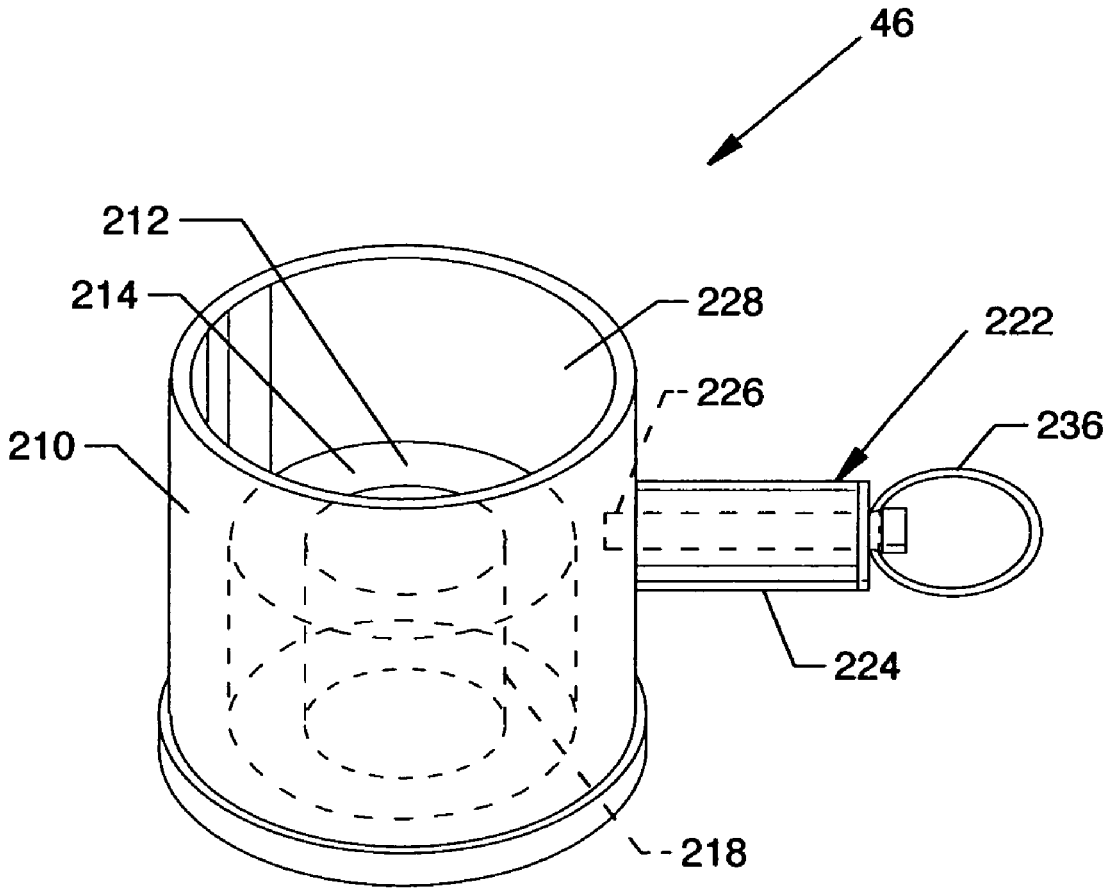
FIG. 19 is an isometric view showing a screw jack connector.
Figure 20:
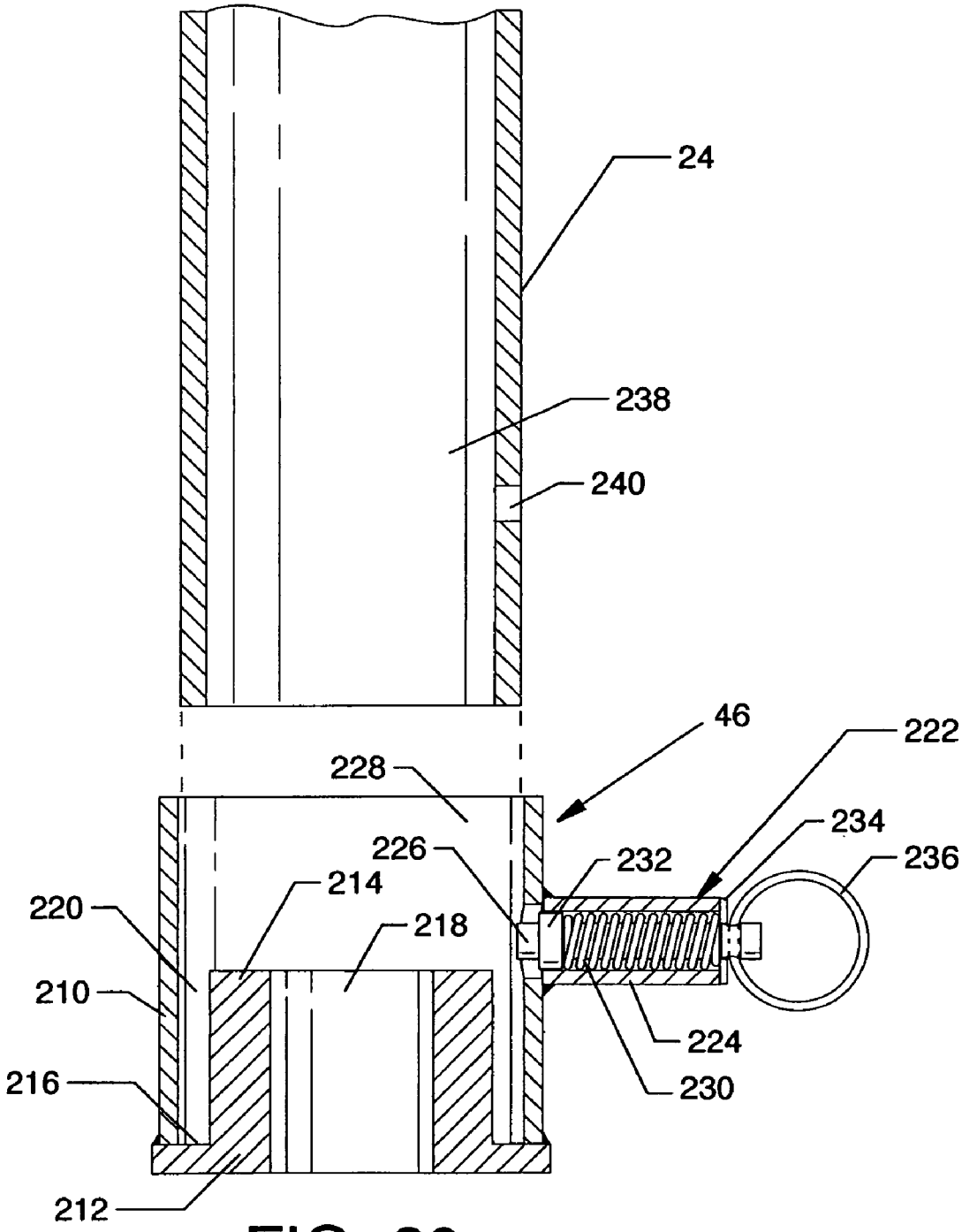
FIG. 20 is a partially exploded cross section view of the components of a screw jack connector in spaced alignment with the bottom portion of a stationary support post.

FIG. 19 is an isometric view showing a screw jack connector 46 which is part of the screw jack 137; FIG. 20 is a partially exploded cross section view of the components of the screw jack connector 46 in spaced alignment with the bottom portion of a stationary support post 24; and FIG. 21 is a partial cross section view showing the screw jack 137 and the relationship of the screw jack threaded shaft 152 with the screw jack connector 46, the bottom of a stationary support post 24, a screw jack adjustment handle 150 and screw jack boss 148, and a baseplate 48.

Each of the screw jack connectors 46 includes a cylinder 210 suitably secured, such as by welding, to a receptor socket 212, wherein the structure of the receptor socket 212, as shown in FIGS. 19 and 20, is similar in many respects to the structure of the threaded receptor socket 156, previously shown. Each of the one-piece receptor sockets 212 is of multiple radius construction, wherein a reduced radius plug 214 of cylindrical form extends from a larger radius annular shoulder 216. A centrally located hole 218 having a smooth surface aligns along the central axis of the one-piece receptor socket 212. The reduced radius plug 214 is sized to form an annulus 220 between the reduced radius plug 214 and the inside wall of the cylinder 210 for accommodation of the bottom portion of a stationary support post 24. A keeper assembly 222 is located on the side of the cylinder 210, and includes a keeper body 224, which can be tubular, a shouldered keeper pin 226 aligned generally within and along the interior of the keeper body 224 and extending a short distance into the open main portion of the bore 228 of the cylinder 210 and extending through a hole in an end plate 234 at the end of the keeper body 224, a spring 230 aligned over and about a portion of the keeper pin 226 in contact with a shoulder 232 of the keeper pin 226 and in contact with the end plate 234 at the end of the keeper body 224, and a grasping ring 236 extending through the outboard end of the keeper pin 226. The stationary support post 24 includes a bore 238 which is accommodated by the outer and annular surface of the plug 214. The lower portion of the stationary support post 24 aligns generally within the bore 228 of the cylinder 210 and within the annulus 220 between the receptor socket 212 and the cylinder 210. A hole 240 in the lower portion of the stationary support post 24 aligns to the inboard end of the keeper pin 226, which is spring-loaded inwardly, to secure the screw jack connector 46, and thus the screw jack 137, to the lower portion of the stationary support post 24.

Figure 21:
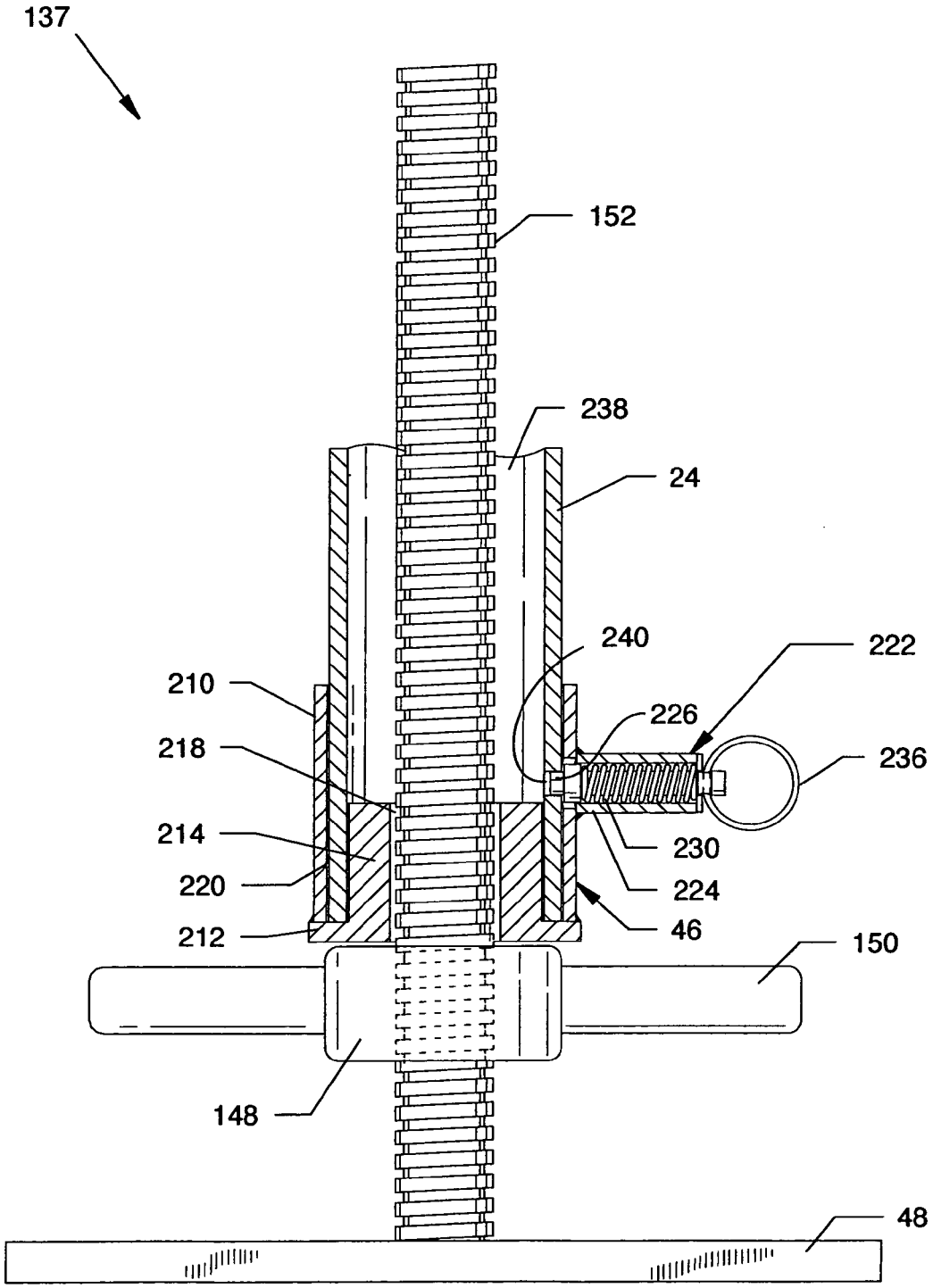
FIG. 21 is a partial cross section view showing a screw jack and the relationship of a screw jack threaded shaft with a screw jack connector, the bottom of a stationary support post, a screw jack adjustment handle and screw jack boss, and a baseplate.

In FIG. 21 the components of FIGS. 19 and 20 are shown in engagement with the other components of the screw jack 137, and more particularly, with a screw jack threaded shaft 152, a screw jack adjustment handle 150, a screw jack boss 148, and the baseplate 48. The screw jack threaded shaft 152 secures to and extends from the baseplate 48 through the interior threads of the screw jack boss 148, through the hole 218 of the receptor socket 212, and thence into the bore 238 of the stationary support post 24. The lower portion of the receptor socket 212 at the lower region of the screw jack connector 46 bears upon the upper surface of the screw jack boss 148, wherein the screw jack boss 148 is operated along and about the screw jack threaded shaft 152 by action of the screw jack adjustment handle 150 to vertically adjust the level of the stationary support post 24 and the components engaging the stationary support post 24.

Figure 22:
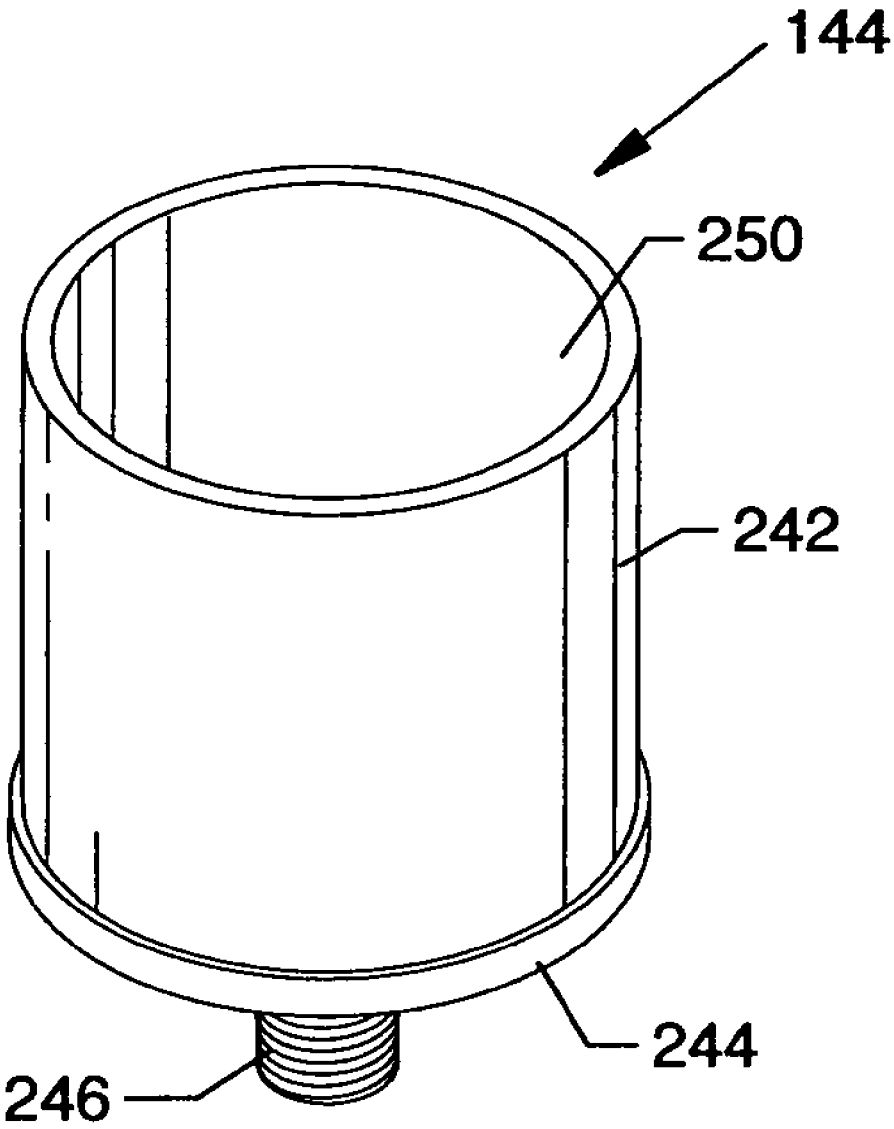
FIG. 22 is an isometric view of one of the post connectors.
Figure 23:
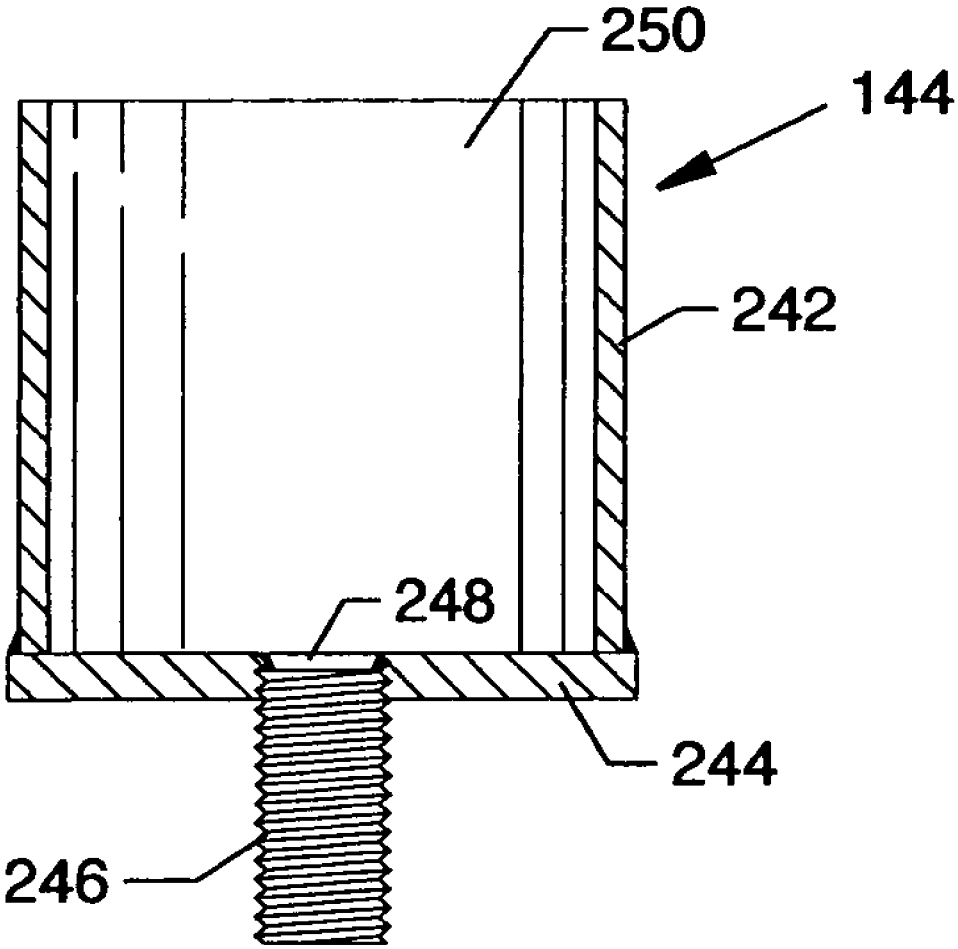
FIG. 23 is a cross section view of one of the post connectors, such as shown in use in FIG. 12.

FIG. 22 is an isometric view of one of the post connectors 144; and FIG. 23 is a cross section view of one of the post connectors 144, such as shown in use in FIG. 12 to connect the bottom of stationary support posts 24 of the upper support post assemblies **22*aa* and 22*bb* to the positionable lower support posts 26 of the support post assemblies 22*a* and 22*b*. Each of the post connectors 144 includes a cylinder 242 suitably secured, such as by welding, to a disk-shaped base 244. A threaded shaft 246 can be threaded into a threaded hole 248 in the disk-shaped base 244 or, alternatively, the threaded shaft 246 can be aligned within an unthreaded similarly located hole central to the disk-shaped base 244 and secured therein by welding or other suitable means. The bore 250 of the cylinder 242 is incorporated to accommodate the lower portion of a stationary support post 24. The threaded shafts 246 of the post connectors 144 engage the threaded holes 162** of the threaded receptor sockets 156 located in the tops of the positionable support posts 26 of the lower support post assemblies 22*a* and 22*b* and are rotated to intimately and planarly engage the bases 244 of the post connectors 144 to the tops of the threaded receptor sockets 156, thereby offering a suitable and stable association therebetween. In the alternative, the cylinder 242, the disk-shaped base 244, and the threaded shaft 246 could be combined using various combinations into a unitary one-piece structure.

FIG. 24 is a cross section view of one of the adjustable foot support posts 146 previously shown in use in FIGS. 11 and 12. The adjustable foot support post 146 includes a cylinder 252, which can be of various lengths, as required, and a previously described threaded receptor socket 156 (which can be of reduced size) which secures in the bore 253 of the cylinder 252 using holes 254 and 256 in the lower portion of the cylinder 252 aligned to the holes 164 and 165 of the threaded receptor socket 156 into which extend roll pins 166. A threaded shaft 258 securing into an adjustment nut 260 engages the threads of the threaded hole 162 of the threaded receptor socket 156 and includes a tip 262 of suitable material, such as, but not limited to, rubber, plastic, or the like located at one side of the adjustment nut 260.

Mode of Operation

Figure 25:
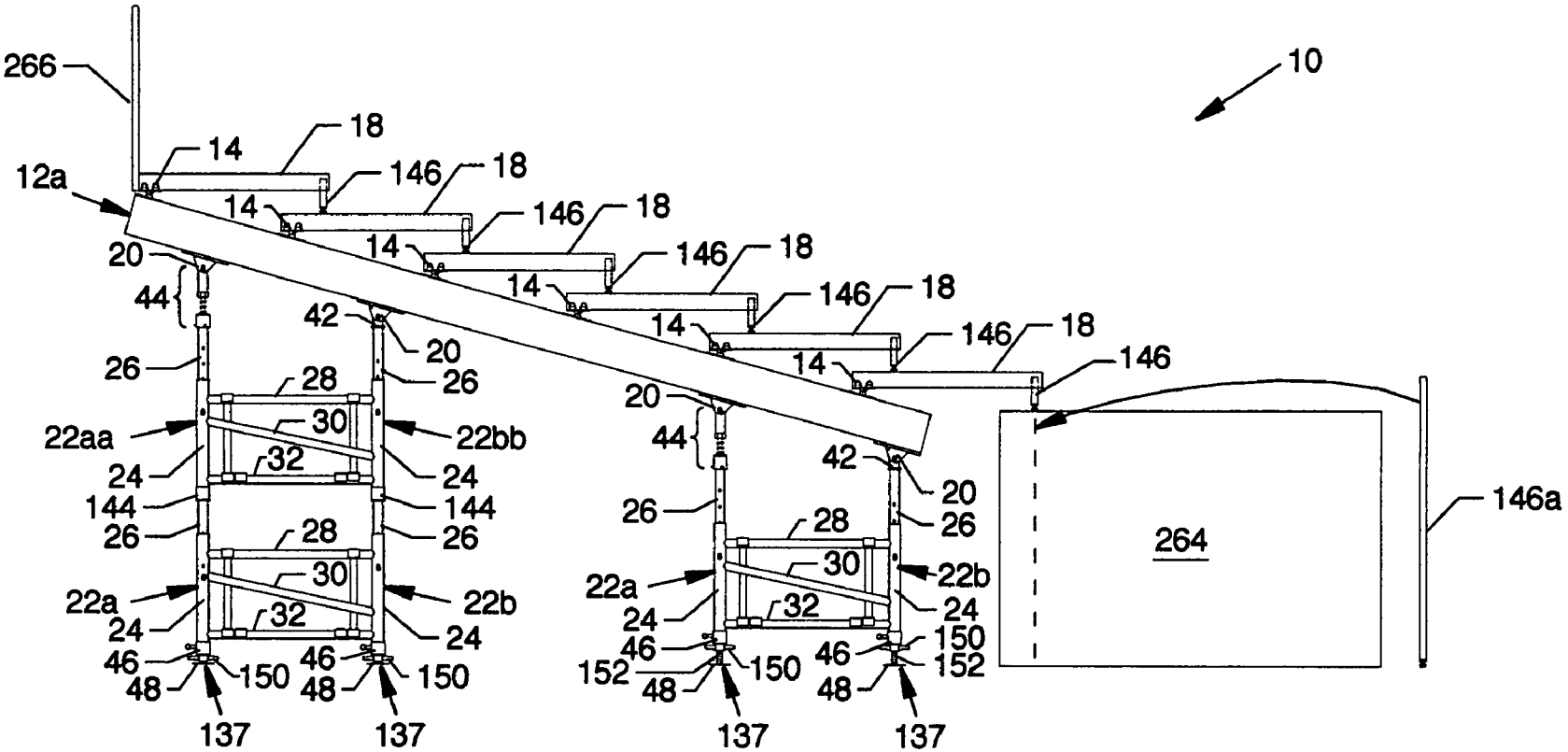
FIG. 25 is a side view showing one configuration of the multipurpose adjustable panel system, such as shown in FIG. 12, which can also incorporate a rear vertically oriented panel.

FIG. 25 is a side view showing one configuration of the multipurpose adjustable panel system 10, such as shown in FIG. 12, which can also incorporate a rear vertically oriented panel 266. A great degree of versatile adjustability is incorporated into the structure of the invention. A first example of adjustability involves the combined vertical slidable telescoping relationship of the components of the rearwardly placed and forwardly placed groups of support post assemblies 22*a*, 22*b*, 22*c* and 22*d*, as well as corresponding stacked groups of support post assemblies 22*aa*, 22*bb*, 22*cc* and 22*dd*, of which the latter two of each group are not shown for purposes of brevity and clarity. Also involved as part of the first example of adjustability is the coordinated near simultaneous horizontal spacing adjustment of the components of the rearwardly placed and forwardly placed groups of support post assemblies 22*a*, 22*b*, 22*c* and 22*d*, as well as corresponding stacked groups of support post assemblies 22*aa*, 22*bb*, 22*cc* and 22*dd* along the beams 12*a* and 12*b*. The stationary support posts 24 slidingly accommodate the positionable support posts 26 within the interiors of the stationary support posts 24, and the positionable support posts 26 are fixed therein by the use of locking pins 136 extending therethrough in use as part of a first adjustment, wherein the positionable support posts 26 having fixed connectors 42 are positioned to nearly achieve the required pitch of the beams 12*a* and 12*b*. Then, the spacing of the groups of forwardly and rearwardly placed groups of support post assemblies mentioned above can be varied along the beams 12*a* and 12*b* to additionally affect the pitch of the beams 12*a* and 12*b* to accomplish the remainder of the first adjustability example. The ability of the pivotable beam support fixtures 20 to be horizontally spaced at various distances is fostered by the ability of the pivotable beam support fixtures 20 to accommodatingly slide along the lower slot 82 of the beams 12*a* and 12*b*. Such allows readily accomplished setup. The combination of vertical adjustment of the support post assemblies, as well as the horizontal spacing of the groups of support post assemblies, provides for continuous pitch adjustability of the beams 12*a* and 12*b*.

A second vertically adjusted support feature is provided by the use of the adjustable connectors 44 between the top of other positionable support posts 26 and the pivotable beam support fixtures 20, such as in the support post assemblies 22*a*, 22*aa*, 22*c* and 22*cc*, where the adjustable connectors 44 are adjusted to provide additional support of the beams 12*a* and 12*b*. Once satisfactory pitch is achieved according to the first adjustability example and, assuming that the adjustable connectors 44 are at minimum extension height and unconnected, the positionable support posts 26 and the adjustable connectors 44 atop the positionable support posts 26 can then suitably be adjusted upwardly in order to connect the adjustable connectors 44 to the pivotable beam support fixtures 20 by the use of locking pins 136. The adjustable connectors 44 can be adjusted after connection to the pivotable beam support fixtures 20. A third vertical adjustment at the bottom of each of the ground level stationary support posts 24 is provided by the use of the screw jack 137 incorporating the screw jack connector 46, the screw jack boss 148, the screw jack adjustment handle 150, the screw jack threaded shaft 152, and the baseplate 48. The various combinations of these adjustments provide a continuous adjustability pitch range, as well as provide for overall elevation accommodation on any regular or irregular surface.

The multiple vertical adjustment capability in concert with other key components addresses geometric configurations both vertically and horizontally. With respect to the horizontal aspect, the use of beams 12*a* and 12*b* each having a slot 82 and a bifurcated support panel 54 allows the pivotable beam support fixtures 20 to be slidably positioned, as required, along the slots 82 and bifurcated support panels 54 to any desirable position along the beams 12*a* and 12*b* to facilitate appropriately pitched direct support of the beams 12*a* and 12*b* by the components connected to and by the support post assemblies 22*a*, 22*b*, 22*c* and 22*d*, as well as corresponding stacked groups of support post assemblies 22*aa*, 22*bb*, 22*cc* and 22*dd* atop support post assemblies 22*a*, 22*b*, 22*c* and 22*d*. During such pitch adjustments, the pivotable beam support fixtures 20 are free to pivot in response to the adjustment of the pitch of the beams 12*a* and 12*b*. Once the pitch of the beams 12*a* and 12*b* is satisfactory and the horizontal and vertical adjustments are satisfactory, the position of the pivotable beam support fixtures 20 is securely fixed along the slots 82 and the bifurcated support panels 54 by ensuring that the slots 120 and 122 of the pivotable beam support fixtures 20 each accommodates a bolt 70 and connected unistrut nut 68 followed by tightening of all of the bolts 70 to cause the unistrut nuts 68 to tighten in the slots 82, as previously described.

After pitch fixation of the beams 12*a* and 12*b*, the platform panels 18 can be installed on the upper portions of the beams 12*a* and 12*b* via the pivotable panel support node fixtures 14. As the pitch of the beams 12*a* and 12*b* is changed, so can the spacing change between the pivotable panel support node fixtures 14 along the topsides of the beams 12*a* and 12*b*. Such variable spacing needs are accommodated by the slots 66 which offer continuous locational positions for the pivotable panel support node fixtures 14. The unistrut nuts 68 which connect to the undersides of the baseplates 94 of the pivotable panel support node fixtures 14 by bolts 70 engage the slots 66 at the upper region of the beams 12*a* and 12*b* and can be positionably slid therealong to position the pivotable panel support node fixtures 14 at any suitable location along the lengths of the bifurcated support panels 52, whereupon the bolts 70 are tightened to utilize the unistrut nuts 68 to secure the pivotable panel support node fixtures 14 thereto. Node receptor fixtures 154 on the undersides of corners 16*a* and 16*b* of the platform panels 18 are aligned to one or more of the support nodes 116 on the node plates 112 of the pivotable panel support node fixtures 14 followed by adjustment of the adjustable foot support posts 146 at the undersides of the corners 16*c* and 16*d* which rest upon the upper surfaces of successive lower platform panels 18 to achieve leveling of the platform panels 18. During leveling, the node plates 112 of the pivotable panel support node fixtures 14 are accommodatingly free to pivot, thereby making the installation process at the end having the pivotable panel support node fixtures 14 self-adjusting.

The lowermost platform panel 18 at the end of a series of platform panels 18 can be accommodated in several ways. Sometimes, the multipurpose adjustable panel system 10 can be situated at a level lower than an existing structure 264, such as a stage, a playing field, an access walkway, or the like, and, as such, the lower platform panel 18 incorporates an attached adjustable foot support post 146 for support on the existing structure 264. In the alternative and if an existing structure 264 does not exist, an extended adjustable foot support post 146*a* can be substituted for the adjustable foot support post 146 at the outboard end of the lower platform panel 18, the position of which is shown by a dashed line.

Figure 26:
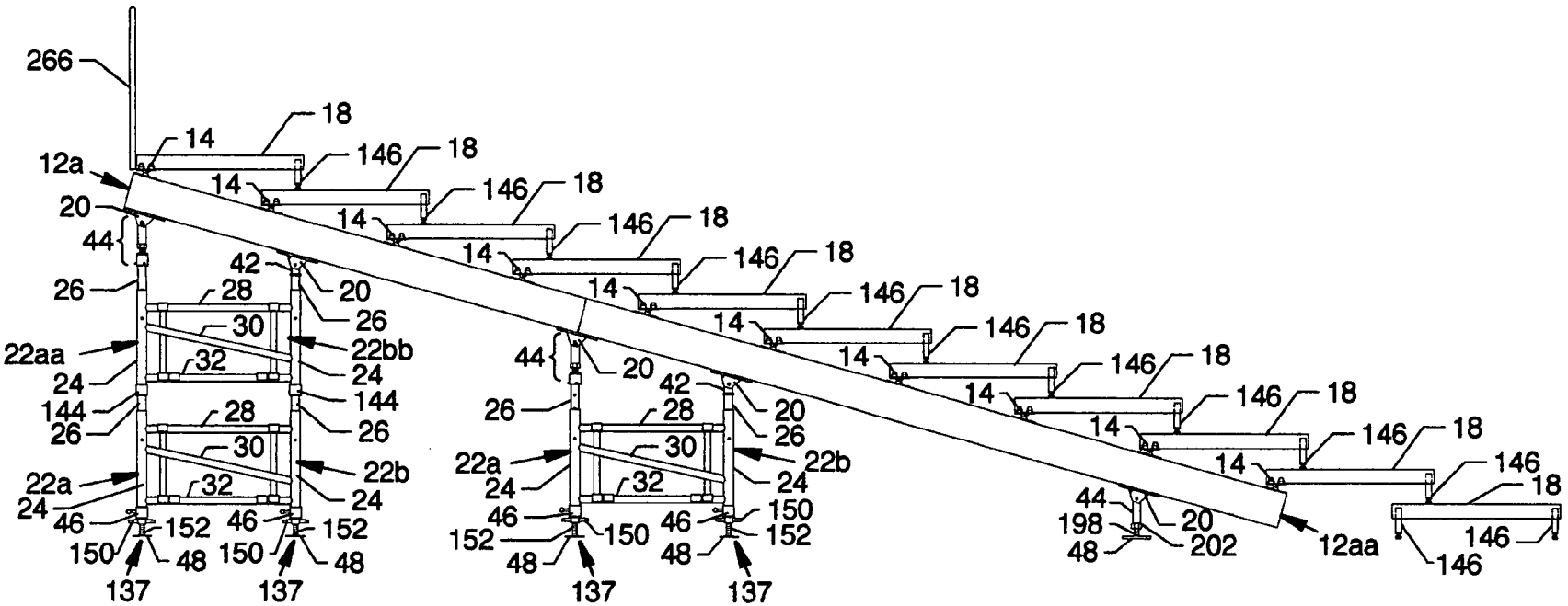
FIG. 26 is a side view showing an extended configuration of the multipurpose adjustable panel system similar in many respects to the configuration shown in FIGS. 12 and 25.

FIG. 26 is a side view showing an extended configuration of the multipurpose adjustable panel system 10, similar in many respects to the configuration shown in FIGS. 12 and 25. An additional beam 12*aa* (and 12*bb*, not shown) is connected to and extends from the lower ends of the beams 12*a* and 12*b* extending beyond the forwardly placed support post assemblies 22*a*, 22*b*, 22*c* and 22*d* to a position near a supporting surface where additional support is provided by pivotable beam support fixtures 20, adjustable connectors 44, nuts 202, threaded shaft 198, and baseplates 48. An additional platform panel 18 at the ground level is supported by multiple adjustable foot support posts 146.

Figure 27:
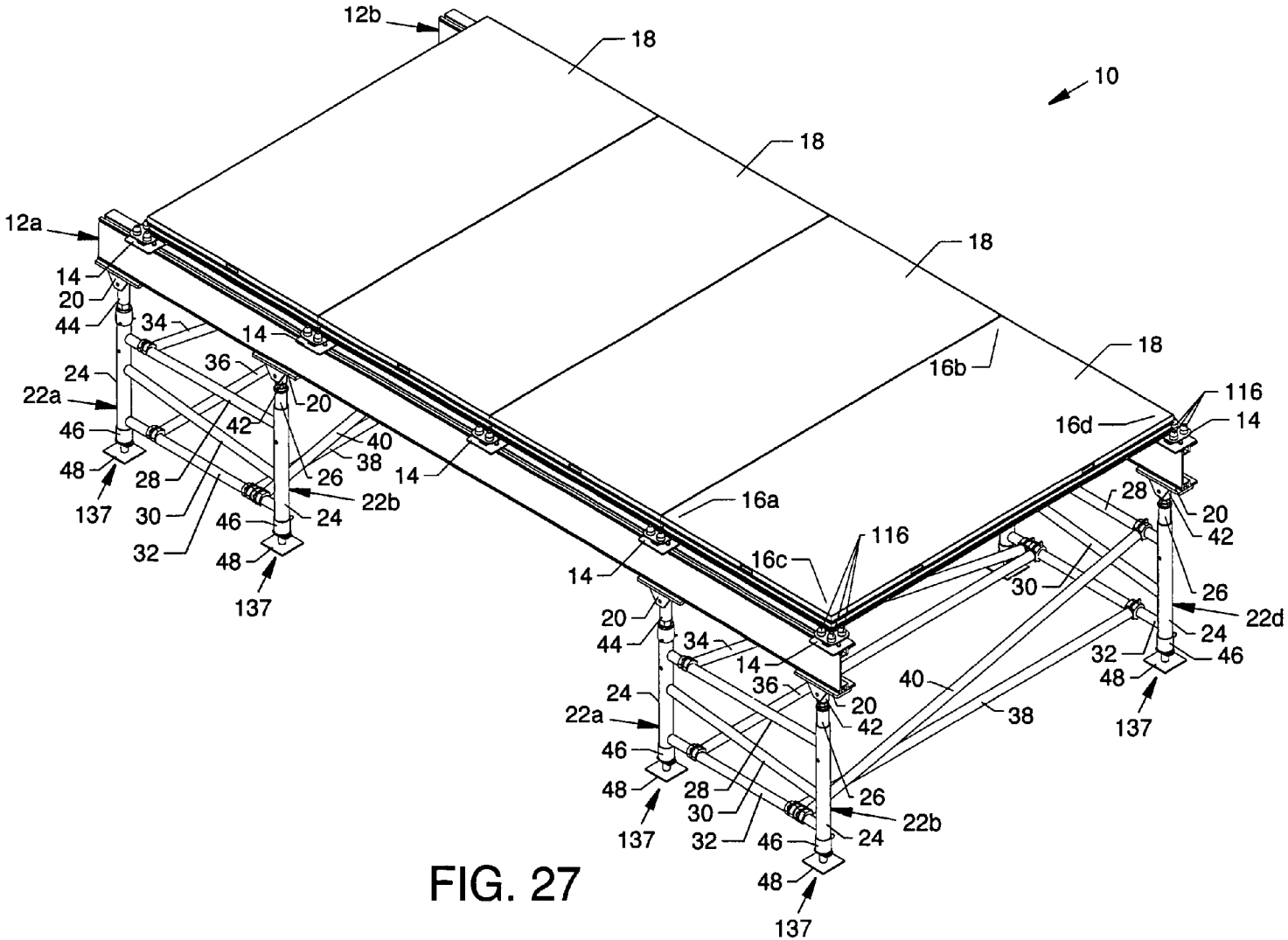
FIG. 27 is an isometric view of a level configuration of a multipurpose adjustable panel system similar in many respects to the configuration shown in FIG. 11.
Figure 28:
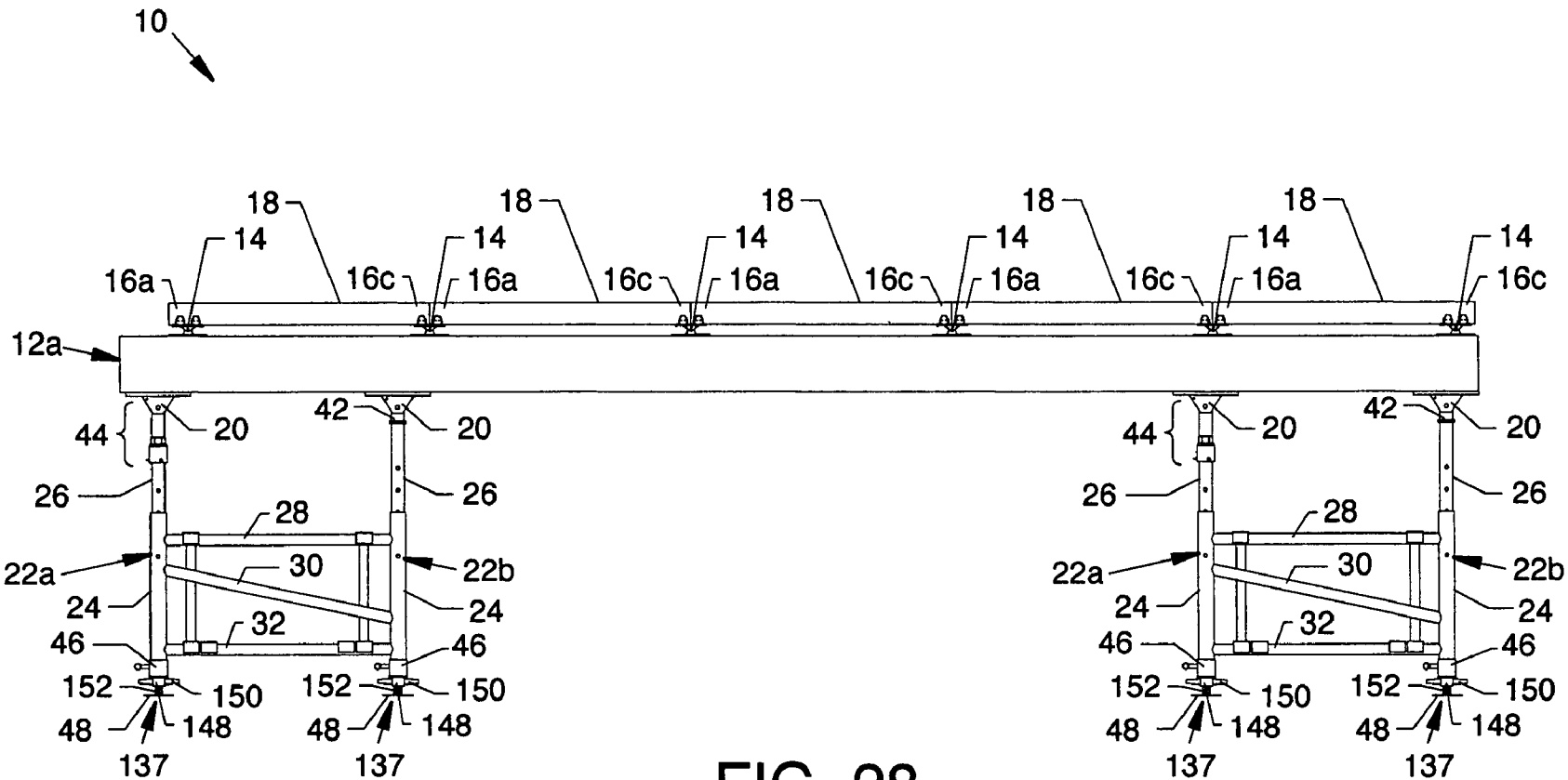
FIG. 28 is a side view of the level configuration of the multipurpose adjustable panel system of FIG. 27.

FIG. 27 is an isometric view of a level configuration of a multipurpose adjustable panel system 10, similar in many respects to the configuration shown in FIG. 11; and FIG. 28 is a side view of the level configuration of the multipurpose adjustable panel system 10 of FIG. 27. In such a configuration, the components closely associated with the support post assemblies 22*a*, 22*b*, 22*c* and 22*d* are adjusted vertically to cause the beams 12*a* and 12*b* to be level and to have no incline or pitch, and the adjustable foot support posts 146 are not utilized. During such leveling, and as true when any incline or pitch adjustment of the beams 12*a* and 12*b* occurs, the baseplates 118 of the pivotable beam support fixtures 20 are caused to adjustably pivot to match the incline or pitch of the beams 12*a* and 12*b*, as do the node plates 112 of the pivotable panel support node fixtures 14. In the alternative, each of the positionable support posts 26 can include a fixed connector 42 at the top portion thereof in lieu of an adjustable connector 44, as the use of an appropriate amount of adjustable connectors 44 is required when the beams 12*a* and 12*b* are required to maintain an incline or pitch other than a zero pitch. However, the use of adjustable connectors 44 can be used exclusively, if desired. Each of the corners 16*a*-16*d* of the platform panels 18 can engage one or more support nodes 116 of the pivotable panel support node fixtures 14. The platform panels 18 are arranged adjacent to one another to present a flat planar surface which is elevated and which is suitable for multiple purposes, such as, but not limited to, use as a support for level seating, staging, workers working on an overhead project, for example, or any other situation requiring the use of an elevated platform. The platform panels 18 illustrated in FIG. 27 are shown engaging only some of the support nodes 116 of each pivotable panel support node fixture 14, whereby the remaining support nodes 116 are available for accommodation of adjacently placed structures. For purposes of example and illustration, an additional structure, such as shown in FIG. 27, could be added longitudinally to one or both ends of the supported beams 12*a* and 12*b* to add length. With respect to lateral additions, additional beams, such as beams 12*a* and 12*b* supported in the fashion as previously described, could be spaced from and added to both or either side of the structure shown in FIG. 27, including additional cross braces 34, 36, 38 and 40; and platform panels 18 could be added and supported by the support nodes 116 of common pivotable panel support node fixtures 14.

Figure 29:
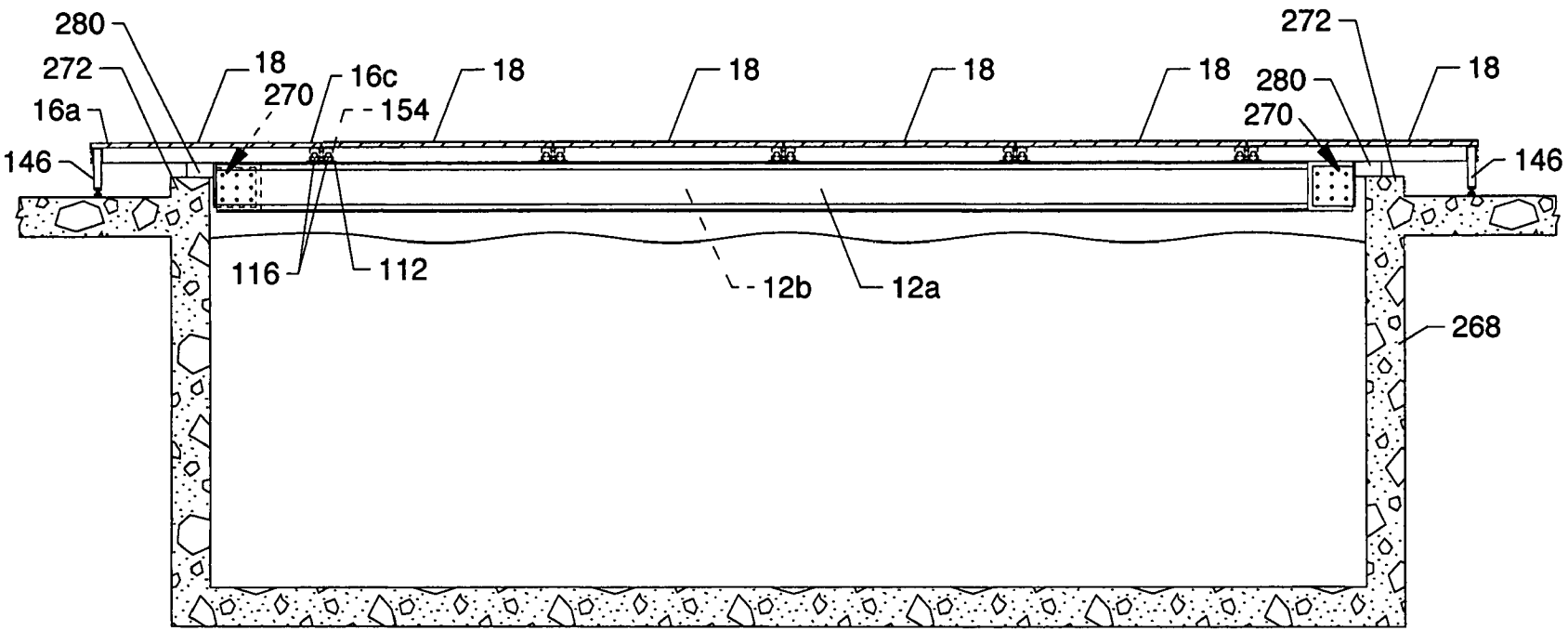
FIG. 29 is a side view in partial cross section illustrating the use of various components of the present invention, including the use of mated beams and a plurality of platform panels and other associated components to serve and function as a cover having robust supportive qualities.

FIG. 29 is a side view in partial cross section illustrating the use of various components of the present invention, including the use of mated beams 12*a* and 12*b* and a plurality of platform panels 18 and other associated components to serve and function as a cover having robust supportive qualities capable of supporting heavy snowfalls, animals treading thereupon, personnel walking thereupon, and the like. Although the description describes use with a swimming pool 268, the various components of the present invention could be incorporated to span open areas of partially completed construction sites, missing sidewalk spans, and other multiple undisclosed uses.

Figure 30:
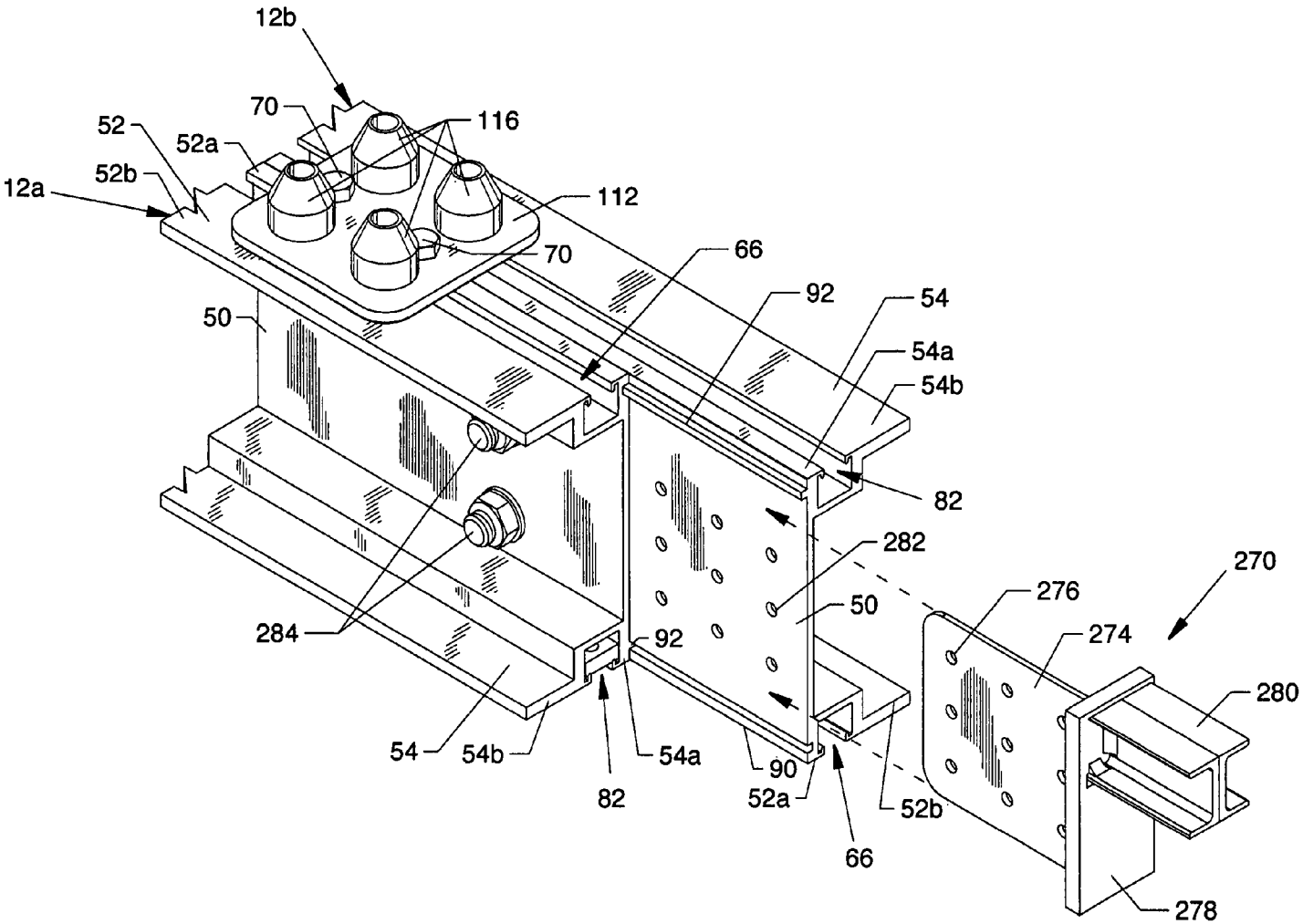
FIG. 30 is an isometric view of a set of mated beams, oriented in the fashion depicted in FIG. 3, along with one of two suspension assemblies located at the ends of the mated beams for contacting and resting upon the lip(s) of a swimming pool or upon portions of other structures.

FIG. 30 is an isometric view of a set of mated beams 12*a* and 12*b*, oriented in the fashion depicted in FIG. 3, along with one of two suspension assemblies 270, as also shown in FIG. 29, incorporated at the ends of the mated beams 12*a* and 12*b* for contacting and resting upon the lip(s) 272 of the swimming pool 268. A plurality of node plates 112, including a plurality of support nodes 116 affixed to the upper surfaces thereof, are secured to either of the slots 66 or 82 of the beams 12*a* and/or 12*b*, as appropriate, using a plurality of unistrut nuts 68 and bolts 70. The support nodes 116 accommodate the node receptor fixtures 154 at the corners 16*a*-16*d* of the platform panels 18. A plurality of adjustable foot support posts 146 are utilized at the lower periphery of some of the platform panels 18 for support of the edges of the platform panels 18. The suspension assemblies 270 include a vertically oriented plate 274 having a plurality of holes 276 which is aligned perpendicularly to and suitably secured, such as by welding, to another vertically aligned plate 278 to which a horizontally oriented stub beam 280 which can be comprised or two back-to-back channels is attached. Alternatively, the stub beam 280 can be of single I-beam construction aligned perpendicularly to and suitably secured, such as by welding, to the plate 278. A plurality of holes 282, matching the holes 276 in the plate 274 of the suspension assembly 270, are included at the ends of the beams 12*a* and 12*b* and are incorporated with the use of suitable fasteners (not shown), such as bolts and nut assemblies, rivets, and the like, extending therethrough, for fastening of the suspension assemblies 270 to the panels 50 of the beams 12*a* and 12*b*. Also shown is a plurality of nut and bolt assemblies 284 extending through the holes 93 for fastening the beam 12*a* to the beam 12*b*.

Figure 31:
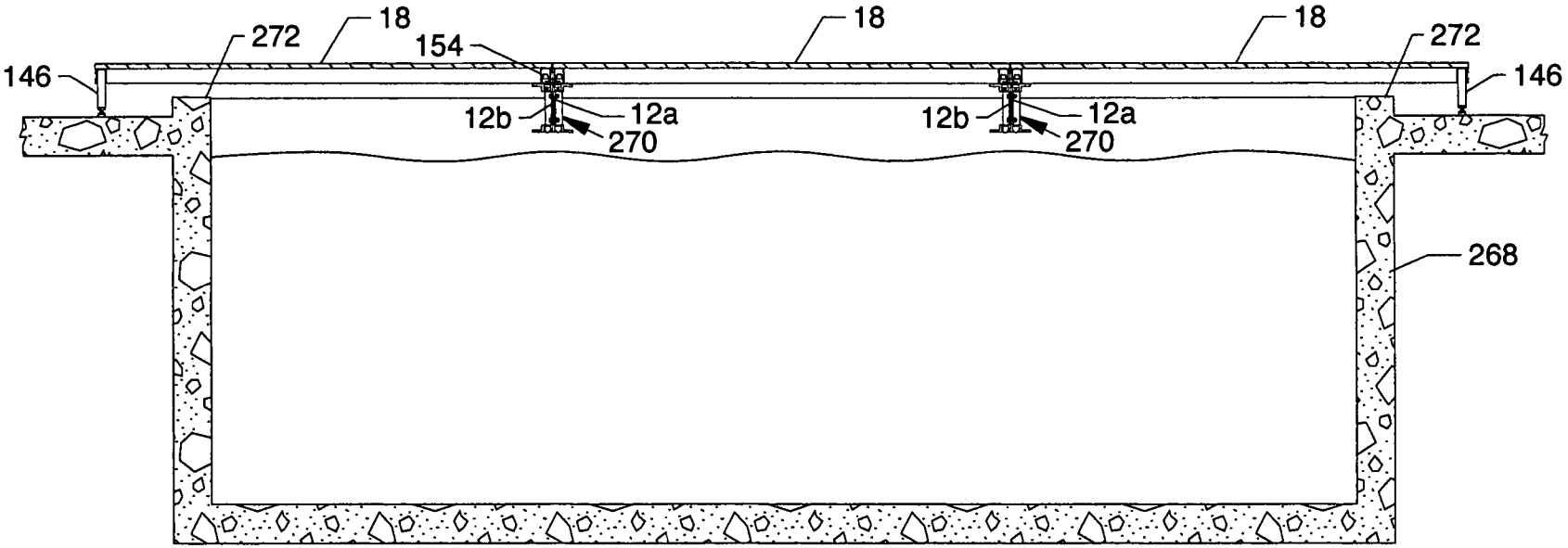
FIG. 31 is an end view in partial cross section illustrating the use of various components of the present invention, including the use of sets of mated beams and a plurality of platform panels and other associated components to serve and function as a cover.

FIG. 31 is an end view in partial cross section illustrating the use of various components of the present invention, including the use of sets of mated beams 12*a* and 12*b* and a plurality of platform panels 18 and other associated components to serve and function as a cover.

Figure 32:
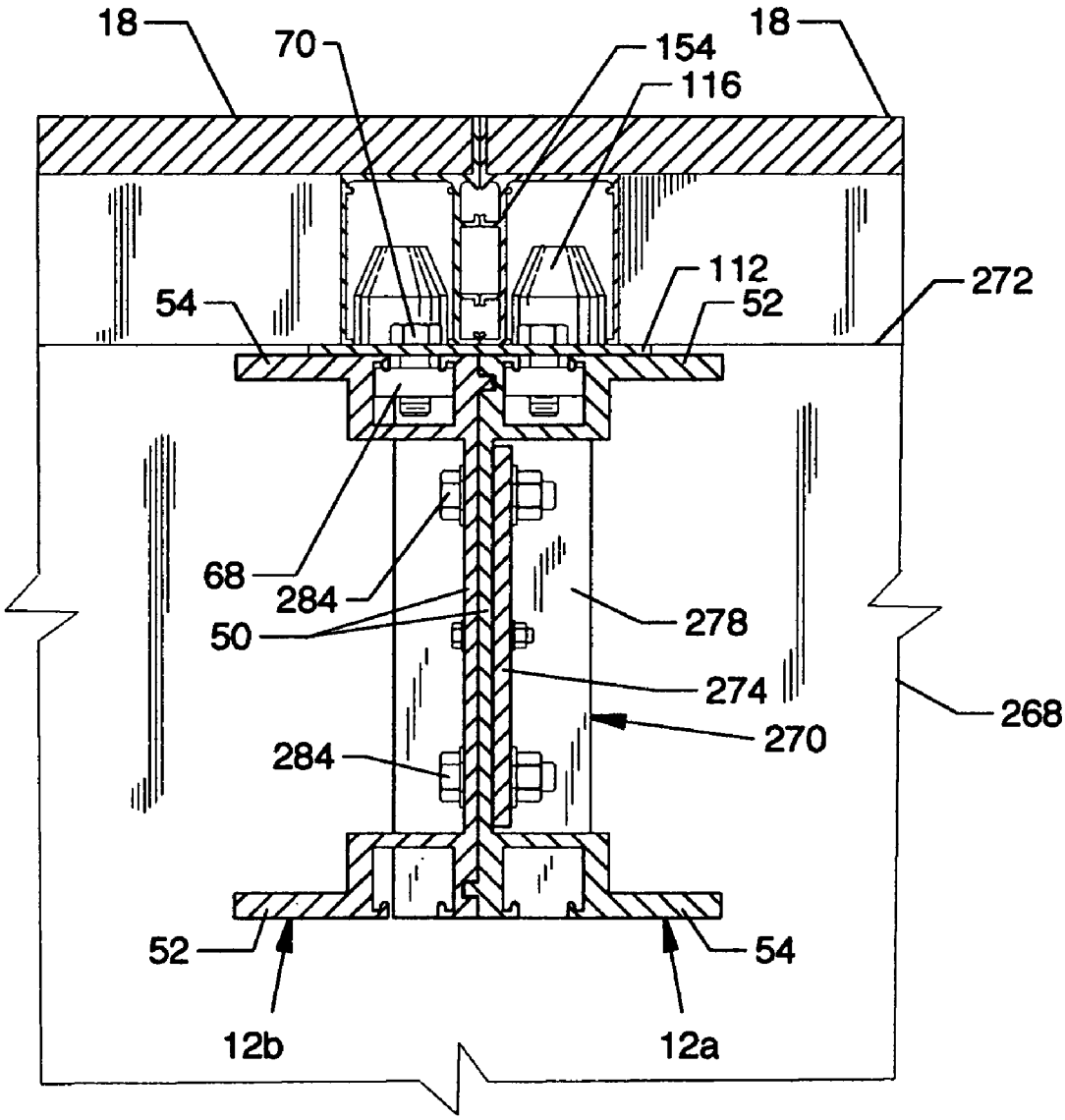
FIG. 32 is a cross section view of the mated beams of FIG. 30 showing the relationship of the node plate and nodes, the beams, the plate, the receptor fixtures, the platform panels, and other components to each other; and, FIG. 33 is a top view showing a plurality of platform panels supported over a swimming pool by sets of mated beams.

FIG. 32 is a cross section view of the mated beams 12*a* and 12*b* of FIG. 30 showing the relationship of the node plate 112 and support nodes 116, the beams 12*a* and 12*b*, the plate 274, the node receptor fixtures 154, the platform panels 18, and other components to each other.

Figure 33:
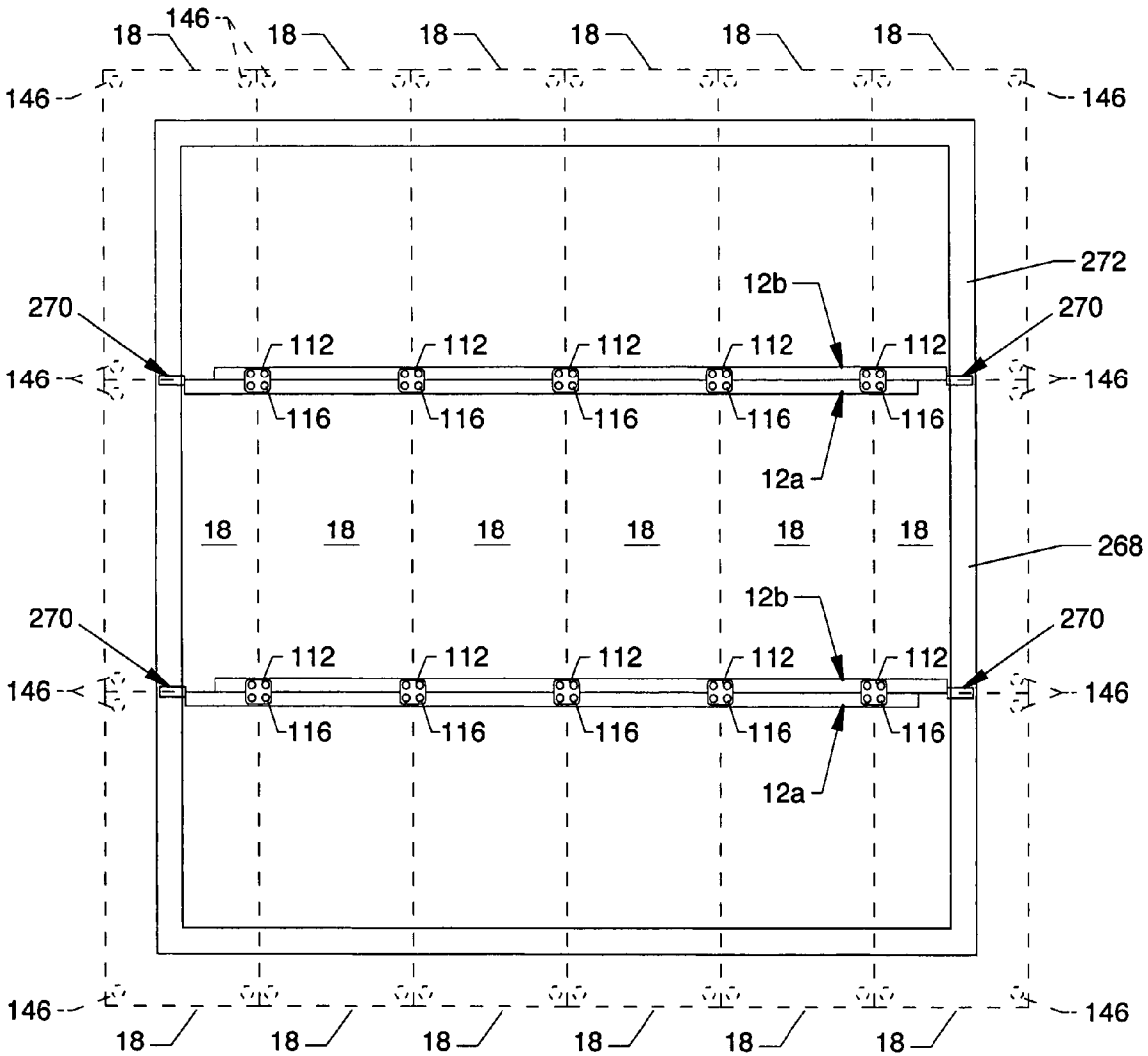

FIG. 33 is a top view showing a plurality of platform panels 18 aligned to and accommodated by a plurality of node plates 112 having support nodes 116 secured to the slots 66 and/or 82 of the mated beams 12*a* and 12*b*. Also shown is the alignment of the suspension assemblies 270 to the lips 272 of the swimming pool 268. A plurality of adjustable foot support posts 146 are also shown supporting the outer edges of the platform panels 18.

Various modifications can be made to the present invention without departing from the apparent scope thereof.

PARTS LIST

10 multipurpose adjustable panel system
12*a-b* beams
12*aa* beam
14 pivotable panel support node fixture
16*a-d* corners
18 platform panel
20 pivotable beam support fixture
22*a-d* support post assemblies
22*aa* support post assembly
22*bb* support post assembly
22*cc* support post assembly
22*dd* support post assembly
24 stationary support post
26 positionable support post
28 interconnect tube
30 interconnect tube
32 interconnect tube
34 cross brace
36 cross brace
38 cross brace
40 cross brace
42 fixed connector
44 adjustable connector
46 screw jack connector
48 baseplate
50 panel
52 bifurcated support panel
52*a-b* panel sections
54 bifurcated support panel
54*a-b* panel sections
56 contact track
58 contact track
60 space
62 panel
64 panel
66 slot
68 unistrut nut
70 bolt
72 contact track
74 contact track
76 space
78 panel
80 panel
82 slot
84 groove
86 groove
88 threaded hole
90 groove
92 projection
93 hole
94 baseplate
96 elongated hole
98 elongated hole
100 pivot mount
101 hole
102 pivot mount
103 hole
104 pivot mount
105 hole
106 pivot mount
107 hole
108 pivot plate
109 hole
110 pivot plate
111 hole
112 node plate
114 pivot bolt
115 nut
116 support node
118 baseplate
120 slot
122 slot
124 hole
126 guide bar
128 pivot mount
130 pivot mount
132 pivot hole
134 pivot hole
136 locking pin
137 screw jack
138 grasping ring
140 taper
142 detent ball
144 post connector
146 adjustable foot support post
146*a* extended adjustable foot support post
148 screw jack boss
150 screw jack adjustment handle
152 screw jack threaded shaft
154 node receptor fixture
156 threaded receptor socket
158 plug
160 shoulder
162 threaded hole
164 hole
165 hole
166 roll pin
168 interrupted hole
170 bore
172 cylinder
174 base
176 threaded shaft
178 threaded hole
180 hole
182 cap
184 cylinder
186 circular plate
188 threaded shaft
190 bore
192 threaded hole
194 threaded hole
196 thumbscrew
198 threaded shaft
200 threads
202 nut
204 cylinder
206 bore
208 hole
210 cylinder
212 receptor socket
214 plug
216 shoulder
218 hole
220 annulus
222 keeper assembly
224 keeper body

226 keeper pin
228 bore
230 spring
232 shoulder
234 end plate
236 grasping ring
238 bore
240 hole
242 cylinder
244 base
246 threaded shaft
248 threaded hole
250 bore
252 cylinder
253 bore
254 hole
256 hole
258 threaded shaft
260 adjustment nut
262 tip
264 existing structure
266 rear vertically oriented panel
268 swimming pool
270 suspension assembly
272 lip
274 plate
276 holes
278 plate
280 stub beam
282 hole
284 nut and bolt assembly

The invention claimed is:

1. A multipurpose adjustable panel system comprising:

a. a plurality of horizontal platform panels, each of the horizontal platform panels having rearward corners and forward corners;

b. a plurality of pivotable panel support node fixtures, each of the pivotable panel support node fixtures carrying a rearward corner of one of the horizontal platform panels of the plurality of platform panels and each of the pivotable panel support node fixtures have a bolt extending downward therefrom;

c. a pair of geometrically configured beams, the pair of geometrically configured beams oriented parallel to and spaced apart from each other and adapted to be pitched from level to steeply inclined, each of the opposed geometrically configured beams having a longitudinally extending slot for accepting the downward extending bolts of the pivotable support node fixtures; and, d. a plurality of nuts for locking the downward extending bolts of the pivotable panel support node fixtures to the longitudinally extending slots of the geometrically configured beams.

2. The multipurpose adjustable panel system of claim 1, wherein the pair of geometrically configured beams are inclined and further comprising:

a. a plurality of adjustable foot support posts, each of the adjustable foot support posts carrying a forward corner of the horizontal platform panels.

3. The multipurpose adjustable panel system of claim 2, wherein each of the adjustable foot support posts of the plurality of adjustable foot support posts rests upon a rearward corner of an adjacent horizontal platform panel of the plurality of horizontal platform panels.

4. The multipurpose adjustable panel system of claim 1, wherein the pair of geometrically configured beams are level and further comprising:

a. a second plurality of pivotable panel support node fixtures, each of the pivotable panel support node fixtures of the second plurality carrying a forward corner of one of the horizontal platform panels of the plurality of platform panels and each of the pivotable panel support node fixtures have a bolt extending downward therefrom; and, b. a second plurality of nuts for locking the downward extending bolts of the second plurality of pivotable panel support node fixtures to the longitudinally extending slots of the geometrically configured beams.

5. The multipurpose adjustable panel system of claim 1, further comprising:

a. a plurality of support post assemblies for supporting each of the geometrically configured beams at a desired pitch.

6. The multipurpose adjustable panel system of claim 5, wherein each of the support post assemblies of the plurality of support post assemblies include an upwardly extending bolt and wherein each of the geometrically configured beams of the pair of geometrically configured beams include a second longitudinally extending slot for accepting the upwardly extending bolts of the support post assemblies and further comprising:

a. a second plurality of nuts for locking the upwardly extending bolts of the support post assemblies in the second longitudinally extending slot of the geometrically configured beams.

7. The multipurpose adjustable panel system of claim 5, wherein each support post assembly includes:

a. a stationary support post;

b. a positionable support post slidingly accommodated within the stationary support post; and, c. a pin positionally fixing the positionable support post to the stationary support post.

8. The multipurpose adjustable panel system of claim 7, wherein the support post assemblies are grouped in groups of at least two support post assemblies, the groups being defined by at least one interconnect tube extending between and securing the stationary support post of a first support post assembly of the group to the stationary support post of a second support post assembly of the group.

9. The multipurpose adjustable panel system of claim 8, wherein the first support post is interconnected to the second support post by a second interconnect tube.

10. The multipurpose adjustable panel system of claim 9, wherein the at least one interconnect tube and the second interconnect tube are secured by a cross brace tube extending between the at least one interconnect tube and the second interconnect tube.

11. The multipurpose adjustable panel system of claim 7, wherein each support post assembly includes a screw jack assembly extending downwardly from the stationary support post.

12. The multipurpose adjustable panel system of claim 8, wherein the first support post assembly of the group includes a fixed connector carrying the upwardly directed bolt and the second support post assembly of the group includes a vertically adjustable connector carrying the upwardly directed bolt.

13. The multipurpose adjustable panel system of claim 6, wherein the upwardly directed bolt of each support post assembly is carried on a pivotable beam support fixture.

14. The multipurpose adjustable panel system of claim 13, wherein two like groups of support post assemblies are secured in a spaced apart relationship by cross braces such that the pair of spaced apart parallel geometrically configured beams are supported in an orientation adapted to be pitched from level to steeply inclined.

15. The multipurpose adjustable panel system of claim 14, wherein each geometrically configured beam is supported by at least two groups of support post assemblies.

16. The multipurpose adjustable panel system of claim 7, wherein the support post assembly further includes a second stationary support post slidably accommodating an upper portion of the positionable support post and a second positionable support post slidably accommodated within the second stationary support post and second and third pins for positionally fixing the second positional support post to the second stationary support post and the second stationary support post to the upper portion of the positionable support post, respectively.

17. The multipurpose adjustable panel system of claim 6, wherein each of the longitudinally extending slots of the geometrically configured beams is formed within a bifurcated support panel, each beam having an upper bifurcated support panel and a lower bifurcated support panel the upper and lower bifurcated support being parallel and spaced apart by a vertical panel.

18. The multipurpose adjustable panel system of claim 17, wherein each bifurcated support panel has a first panel section and a second panel section with the longitudinally extending slot therebetween.

19. The multipurpose adjustable panel system of claim 18, wherein the slots are configured to accept a unistrut nut and the first and second plurality of nuts are unistrut nuts.

20. The multipurpose adjustable panel system of claim 17, wherein each of the slots includes at least one contact track.

21. The multipurpose adjustable panel system of claim 17, wherein each geometrically configured beam may be accommodatingly mated to a like geometrically configured beam.

22. The multipurpose adjustable panel system of claim 21, wherein each geometrically configured beam includes at least one hole in the vertical support panel to facilitate mating attachment to a like geometrically configured beam by fastening thereto.

23. The multipurpose adjustable panel system of claim 21, wherein each geometrically configured beam has a groove and a corresponding projection extending longitudinally along the vertical support panel to facilitate alignment of like geometrically configured beams in an accommodative mating arrangement.

24. The multipurpose adjustable panel system of claim 1, wherein each pivotable panel support node fixture includes:

a. a baseplate, the baseplate having a hole for accommodation of the bolt extending downward from the pivotable panel support node fixture and a pivot mount extending upward from the baseplate;

b. a node plate, the node plate having a pivot plate extending downward from the node plate; and, c. a pivot, the pivot pivotally connecting the pivot mount to the pivot plate.

25. The multipurpose adjustable panel system of claim 1, wherein the pivot is a pivot bolt, and the pivot mount is one of a plurality of pivot mounts, and the pivot plate is one of a plurality of pivot plates, and further wherein the pivot bolt pivotally connects the plurality of pivot plates and the plurality of pivot mounts to form a pivotable connection between the baseplate and the node plate, thereby accommodating angular differences between the pitch of the beams and the horizontal platform panels.

26. The multipurpose adjustable panel system of claim 24, wherein the node plate includes at least one node, projecting opposite of the pivot plate.

27. The multipurpose adjustable panel system of claim 24, wherein the at least one node includes a cylindrical body and a frustoconical head, and wherein the horizontal platform panels each have a receptor fixture at an underside of a horizontal platform panel corner for accepting a node.

28. The multipurpose adjustable panel system of claim 27, wherein each node plate has four nodes.

29. The multipurpose adjustable panel system of claim 28, wherein a node plate supports at least two adjoining horizontal panels, such that a first node of the four nodes is received in a receptor fixture of a first horizontal panel corner underside and a second node of the four nodes is received in a receptor fixture of a second horizontal panel corner underside.

30. The multipurpose adjustable panel system of claim 29, wherein the system includes at least three geometrically configured beams in a level pitch and four receptor fixture of four adjoining panels are supported at one node plate.

* * * * *